US008671599B2

(12) United States Patent
Sellars

(10) Patent No.: US 8,671,599 B2
(45) Date of Patent: Mar. 18, 2014

(54) LABELS AND METHODS OF MAKING SAME

(75) Inventor: Neil G. Sellars, Cinnaminson, NJ (US)

(73) Assignee: National Label Company, Inc., Lafayette Hill, PA (US)

( * ) Notice: Subject to any disclaimer, the term of this patent is extended or adjusted under 35 U.S.C. 154(b) by 175 days.

(21) Appl. No.: 13/026,891

(22) Filed: Feb. 14, 2011

(65) Prior Publication Data

US 2011/0198838 A1 Aug. 18, 2011

Related U.S. Application Data

(60) Continuation of application No. 11/607,495, filed on Dec. 1, 2006, now abandoned, and a continuation-in-part of application No. 11/482,095, filed on Jul. 6, 2006, now abandoned, and a continuation-in-part of application No. 11/455,926, filed on Jun. 19, 2006, now abandoned, and a continuation-in-part of application No. 10/744,581, filed on Dec. 23, 2003, now abandoned, and a continuation-in-part of application No. 10/634,442, filed on Aug. 5, 2003, now abandoned, and a continuation-in-part of application No. 09/898,871, filed on Jul. 3, 2001, now abandoned, and a continuation of application No. 09/404,429, filed on Sep. 23, 1999, now Pat. No. 6,613,410, and a continuation of application No. 09/232,121, filed on Jan. 15, 1999, now Pat. No. 6,274,236, and a division of application No. 08/662,842, filed on Jun. 12, 1996, now abandoned, and a continuation-in-part of application No. 08/489,611, filed on Jun. 12, 1995, now abandoned.

(51) Int. Cl.
*G09F 3/00* (2006.01)

(52) U.S. Cl.
USPC ..... 40/310; 40/675

(58) Field of Classification Search
USPC ..... 40/310, 638, 675; 283/81, 106
See application file for complete search history.

(56) References Cited

U.S. PATENT DOCUMENTS

| | | | | |
|---|---|---|---|---|
| 5,262,214 | A * | 11/1993 | Instance | 428/42.1 |
| 5,439,721 | A * | 8/1995 | Pedroli et al. | 428/42.1 |
| 5,766,716 | A * | 6/1998 | Barry | 428/40.1 |
| 5,975,575 | A * | 11/1999 | Instance | 281/2 |
| 6,274,236 | B1 * | 8/2001 | Shacklett et al. | 428/354 |
| 6,541,090 | B2 * | 4/2003 | Grosskopf et al. | 428/40.1 |
| 6,941,689 | B1 * | 9/2005 | Seidl | 40/310 |
| 2003/0118768 | A1 * | 6/2003 | Sellars | 428/40.1 |

FOREIGN PATENT DOCUMENTS

GB 2247661 A * 3/1992

* cited by examiner

*Primary Examiner* — Kristina Junge
(74) *Attorney, Agent, or Firm* — Stradley Ronon Stevens & Young, LLP

(57) ABSTRACT

A label having at least one resealable brochure and being suitable for attachment to a mounting surface includes a base planar member having oppositely disposed first and second surfaces and a first lateral edge, the first surface being suitable for coupling the base planar member to the mounting surface, a brochure sheet including a second lateral edge that partially overlies the base member, a planar overlying member and a planar tab, wherein, a portion of the brochure sheet and overlying member project beyond the first lateral edge of the base planar member such that when the label is attached to the mounting surface, the overlying member may be selectively uncoupled and recoupled to the mounting surface. Also disclosed are methods of making the labels.

31 Claims, 42 Drawing Sheets

LABELS AND METHODS OF MAKING SAME

RELATED APPLICATIONS

This application is a continuation of Ser. No. 11/607,495 which is a continuation-in-part of an Ser. No. 11/482,095, filed Jul. 6, 2006 entitled 'Reactive Labels and Methods of Making and Using the Same', Ser. No. 11/455,926, filed Jun. 19, 2006entitled 'Reactive Labels and Methods of Making and Using the Same', application Ser. No. 10/634,442, filed Aug. 5, 2003 entitled 'Extended Wrap Label', and of application Ser. No. 10/744,581, filed Dec. 23, 2003 entitled 'Labels and Method Of Making Same'. All of which are incorporated by reference in their entirety herewith.

FIELD OF THE INVENTION

The present invention relates in general to labels and, more particularly, to labels and inking of labels for products and product containers.

BACKGROUND OF THE INVENTION

Labels, typically in the form of flexible sheet or web material attached to an object, have long been used to identify the object, its contents and/or display other information associated with the object. Such labels, which are normally fabricated from paper or plastic, are usually adhesively secured to the object by a contact or pressure sensitive adhesive material.

Many objects, such as jars, bottles, cans and similar receptacles support "wrap" labels which cover substantially all of their circumferential side wall surfaces. With these labels, essentially the entire outer surface of the label is available as an indicia bearing surface. A label covering all or nearly all of the circumferential area of an object, such as a product container, is oftentimes sufficient to convey desired advertising, content information, instructions, warnings, and the like. In many circumstances, however, an object's physical dimensions detrimentally limit the available print space of, or the availability to place print on, the label borne thereby.

A common solution to the problem of limited label printable area or limited printability is to affix an additional multi-sheet leaflet or "outsert" to the exterior of the label. While generally effective for providing additional print space or printability, such leaflets complicate the label assembly process in that at least three fabrication steps must be performed, apart from printing and placement of any necessary adhesive and release layers, in order to manufacture the label. That is, the base label must be cut to desired dimensions, the leaflet must be similarly cut and/or folded, and the leaflet must be secured to the base label.

Not only is the label assembly process more complex for making labels that include leaflets, but also this process requires more material than other processes for making simpler labels. The material usage is more or less depending on the container's size, shape, and configuration, and is also dependent upon the way in which numerous labels are prepared. Because labels that include leaflets may be complex configurations, the current methods of cutting the materials for the labels produce scrap material or are labor-intensive. When many labels or parts of labels are made at once using current methods of making labels, the amount of scrap material and the cost of labor become excessive. Thus, a need exists for a less costly, less complex method of making labels with leaflets. In addition, a need exists for a cost efficient method of making labels that include leaflets.

Furthermore, labels which include at least one leaflet secured to them may complicate the packaging process of manufactured products that are packaged in any size bottles or containers. Such leaflet-containing labels could be difficult to effectively and quickly attach to a container in a streamlined manner. Containers having leaflet-containing labels attached to them could be difficult to pack together in a box for shipment without damaging the labels. In these instances, one or more leaflets are sealed into a label before being attached to containers in a way that they may be unsealed by a consumer at a later time after purchase. However, labels containing leaflets may be sealed too tightly or sealed inconspicuously so that consumers of products bearing leaflet-containing labels may have difficulty opening the label to reveal the leaflet or may not know to unseal the label to read product information. Thus, a need exists for a label that includes at least one leaflet to be easily applied to a container, easily opened by a consumer, and easily recognized by a consumer as containing a leaflet so that the consumer will open the label.

The details of the present invention in overcoming the aforementioned limitations of the prior art will become apparent as the following description of the embodiments of the invention proceeds.

SUMMARY OF THE INVENTION

The present invention includes labels and a method of making labels suitable for attaching about an object having a circumference. The method disclosed herein for making a label having at least one resealable brochure and being suitable for attachment to a mounting surface includes providing a base planar member having oppositely disposed first and second surfaces and a first lateral edge, the first surface being suitable for coupling the base planar member to the mounting surface, providing a brochure sheet, laying a portion of the brochure sheet over the base planar member, coupling a portion of the second surface of the base planar member and a portion of the brochure sheet with a planar overlying member, wherein, a portion of the brochure sheet and overlying member project beyond the first lateral edge of the base planar member such that when the label is attached to the mounting surface, the overlying member may be selectively uncoupled and recoupled to the mounting surface. Such method also includes forming a tab in the overlying member and/or brochure sheet(s), wherein the tab-forming step may include the use of die cutting to form at least the tab.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for the purpose of clarity, many other elements found in labels and labeling systems. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Figure 1:
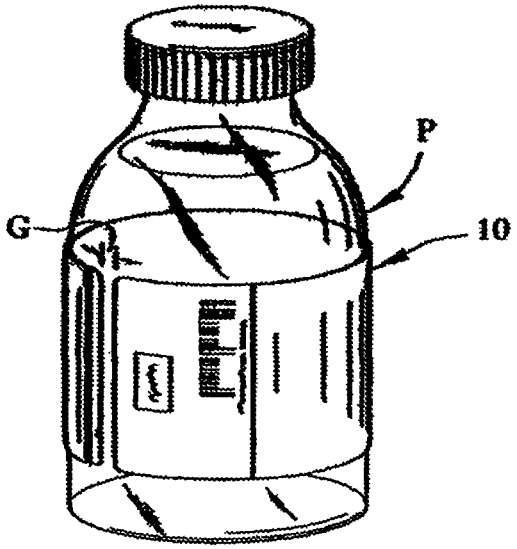
FIG. 1 is a perspective view of a conventional wrap-type label affixed to a product container.

Referring to FIG. 1, there is shown an object, such as a bottle, jar, or any other sort of container, generally referred to herein as container P. Adhesively affixed about the periphery or circumferential side wall of container P may be a wrap-type label 10. Label 10, as is conventional, may cover any fraction of the periphery or circumferential side wall of container P. As illustrated, label 10 may be constructed as an elongated strip member spanning nearly the entire periphery or circumference of container P, and the ends of the label may be separated by a gap G.

Figure 2:
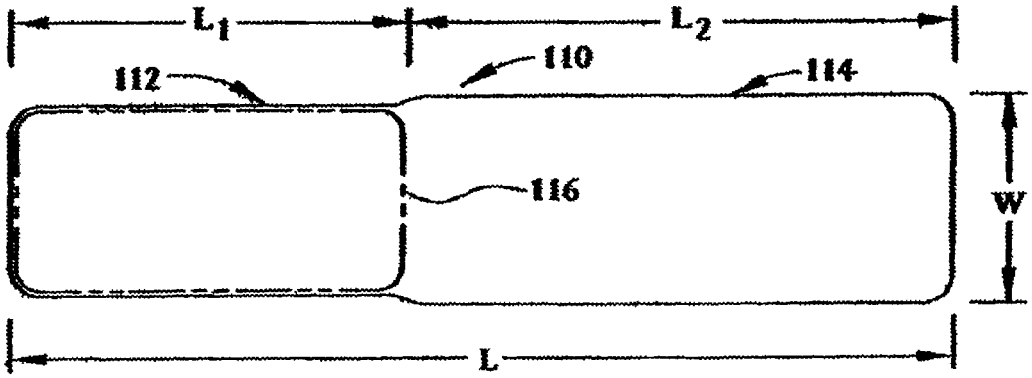
FIG. 2 is a top plan view of a first embodiment of a label constructed in accordance with the present invention.
Figure 3:
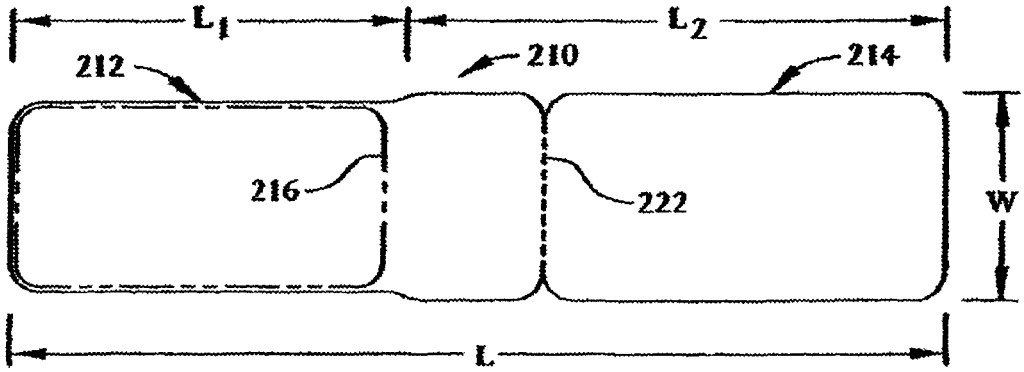
FIG. 3 is a top plan view of a further embodiment of a label constructed in accordance with the present invention.
Figure 4:
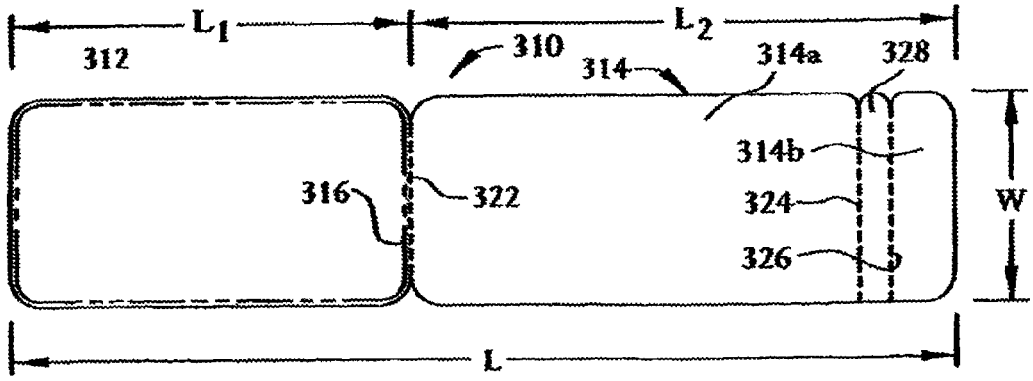
FIG. 4 is a top plan view of a further embodiment of a label constructed in accordance with the present invention.

FIGS. 2, 3 and 4 depict several embodiments of labels which may alleviate the problem of limited print space associated with conventional wrap labels similar to label 10 of FIG. 1. Furthermore, labels constructed in accordance with the present invention may incorporate structural features which impart additional functions and advantages to the label.

The labels according to the present invention, respectively identified by reference numeral 110 in FIG. 2, 210 in FIGS. 3 and 310 in FIG. 4, include several common characteristic features. For example, each may be comprised of a flexible and printable substrate, such as paper, plastic or web material. Although they may be made individually, the labels may be produced from rolls of such substrates, such as paper or plastic sheet stock which may be continuously printed, coated with adhesive, applied with protective material, affixed to release paper, and cut to produce multiple labels as further described herein. Additionally, each label has an area with general dimensions L and W, which may represent the length and width dimensions, respectively, of the label. Length L may be a predetermined distance related to the circumferential dimension of the object to be labeled and width W may be that dimension extending perpendicularly to length L. Width W may vary, as may be desired or necessary, along length L.

As used herein, the terms "circumferential," "circumference," or variants thereof shall be construed to include any distance circumscribing the perimeter of the target object to be labeled, regardless of the shape of the object. For example, the object may comprise a polygonal shape (e.g., square or rectangular), curvilinear shape (e.g., circular or oval) or composite polygonal and curvilinear cross-sectional configuration defining a desired perimetrical exterior wall surface to be covered by label 110, 210, 310, 410, 510, 610, 710, or any other label disclosed herein.

Labels 110, 210 and 310 may each include a first portion 112, 212, and 312, respectively, having a length $L_1$. $L_1$ may be less than or equal to the circumferential dimension of the object to be labeled. In addition, labels 110, 210, and 310 may include second portions 114, 214, and 314, respectively, of length $L_2$, which may be contiguous with first portions 112, 212, and 312. Second label portions 114, 214, and 314 may provide additional length to first label portions 112, 212, and 312, such that the total length L of labels 110, 210, and 310 may be greater than the circumference of the object to be labeled. All or a portion of the underside of first label portions 112, 212, and 312 may be coated with a layer of pressure sensitive or other adhesive having sufficient tackiness to essentially affix the label on the target object, such adhesive being respectively identified by dot-dash lines 116, 216, and 316.

Each of second label portions 114, 214, and 314 may provide additional print space to labels 110, 210, and 310. Thus, both the top and bottom surfaces of the second label portions may be available as printable surfaces. Depending on which of certain other structural features, as described below, are incorporated into the label of the present invention, second label portions 114, 214, and 314 may also function, without limitation, as resealable and/or removable flaps.

The length $L_2$ of second portions 114, 214, and 314 may be dictated by, inter alia, the need for additional print space. The label may therefore include any number of wraps of the second label portion about the target object.

Referring more specifically to FIGS. 2, 3 and 4, in FIG. 2 label 110 may comprise first and second portions 112, 114, which may be contiguous regions of an elongated unitary strip of material. No perforation need exist between first and second label portions 112 and 114, though such perforations may still be present in alternative embodiments. Physical demarcation between first label portion 112 and second label portion may be established by the rightmost edge of the pressure sensitive adhesive 116 underlying first portion 112. The boundary between the first and second label portions 112 and 114 may also be distinguished by a change in width W and/or the printed image carried on the label.

Figure 5:
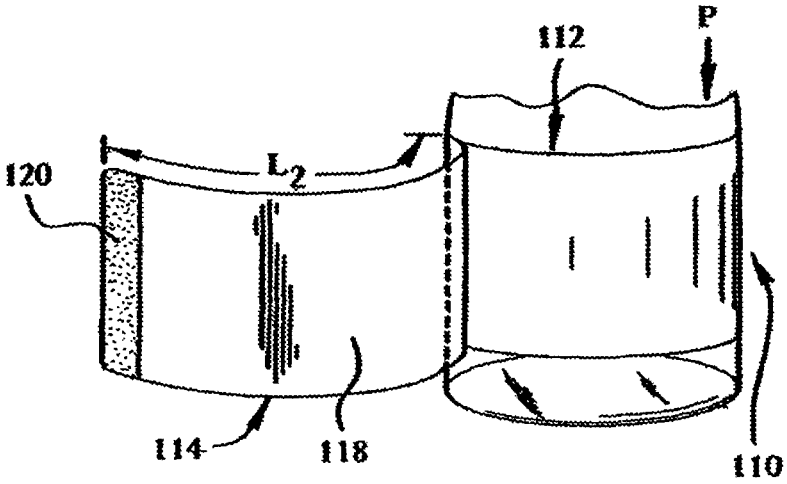
FIG. 5 is a perspective view of a label according to the present invention with a releasable end thereof lifted from the surface of a product container to which the label is affixed.
Figure 6:
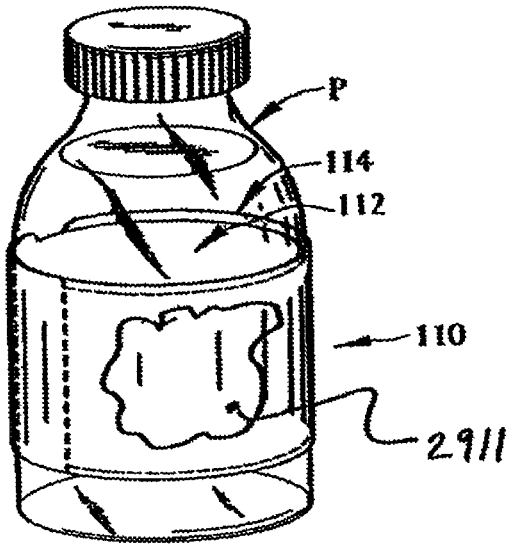
FIG. 6 is a perspective view of the label of FIG. 5 with the releasable end thereof attached to the surface of the product container to which the label is affixed.

FIGS. 5 and 6 are sequential views of the label 110 being applied to an object such as, for example, a product container P. Referring initially to FIG. 5, first label portion 112 of label 110 is shown wrapped about and adhered to the circumference of container P, and second label portion 114 is depicted in a lifted and turned-away disposition so as to expose the bottom surface 118 thereof. Both the top and bottom surfaces of second portion 114 may be available as printable surface areas. To enhance the utility of label 110, a comparatively narrow strip of tack adhesive material 120 may be provided along the distal edge of the bottom surface 118 of the second label portion 114. Alternatively, tack adhesive 120 may be applied in any pattern and to any area of bottom surface 118 of second portion 114 and to as much as the entire bottom surface 118. The tackiness of adhesive material 120 should be such that it may enable the second label portion 114 to be selectively and repeatedly adhered to the first label portion 112 substantially in the manner shown in FIG. 6, and released from the first label portion as in FIG. 5 to expose the bottom surface 118 of second label portion 114, at the end user's discretion. Where the strip of tack adhesive 120 is employed, the label stock may be coated with adhesive to enable the strip to releasably adhere to the top surface of the first label portion.

Although second label portion 114 may be of any length, an example best illustrates the degree to which a second label portion 114 of relatively moderate length may increase the available print surface area of label 110. Assuming that product container P is a generally cylindrical jar or bottle such as in FIGS. 5 and 6, length $L_1$ of the first portion 112 of label 110 is selected to be substantially equal to that of the circumference of container P. Recalling that both the top and bottom surface of the second label portion 114 may be printed, if the length $L_2$ of the second portion 114 is chosen so as to extend for an additional 360° of arc about the circumference of container P, then the total available print surface area may be increased by 200% as compared to the available print surface area of conventional 360° wrap labels. That is, 720° of additional printable surface area may be created in a label which consists of no more than two superimposed layers wrapped about container P. As a consequence, a compact, low-bulk and low thickness resultant label construction may be produced, and may offer essentially three times the print area of a presently existing wrap label such as label 10 of FIG. 1.

FIG. 3 represents a further embodiment of the present invention. According to FIG. 3, label 210 may include a perforation 222 which may be placed at, or, as illustrated, near the boundary between first label portion 212 and second label portion 214. Although not illustrated, second label portion 214 may also include a thin strip of tack adhesive on the bottom surface and at the distal end thereof similar to adhesive material 120 of label 110 (FIG. 5) or in any pattern or to any area of the bottom surface of the second portion. So disposed, the tack adhesive may serve to retain second label portion 214 in contact with first label portion 212 until deployment of the second label position is desired. In this way, some or all of second label portion 214 may be torn from first label portion 212 along perforation 222 to expose the surface of the first label portion previously covered by the second label portion. Additionally, the second label portion may be adapted for a use when detached from the first label portion that may be independent of the function of the first label portion. For example, second label portion 214 may be printed with information such that it may function as a redeemable coupon for consumer merchandise.

In FIG. 4, label 310 may include a perforation 322 generally at or near the boundary between first label portion 312 and second label portion 314. Additionally, second label portion 314 may be provided with a pair of comparatively closely spaced perforations 324 and 326 disposed adjacent the end of second label portion 314 opposite first label portion 312. Perforations 324, 326 together may define a removable tear strip 328, described below, which may separate second label portion 314 into a first, non-adhesive-bearing, removable segment **314*a* and a second adhesive-bearing segment 314*b*. Alternatively, a single perforation may be located in second label portion 314 in order to separate second label portion 314 from segment 314*b***.

The bottom surface of the second label segment **314*b* may be coated with a pressure sensitive or other adhesive (not illustrated) similar to adhesive 316 as provided on first label portion 312. In this way, when label 310 is fully wrapped about an object, such as product container P shown in FIGS. 1, 5 and 6, the first label portion 312 may be essentially affixed to the circumferential wall of the container and the second segment 314*b* of the second label portion 314 may be similarly affixed to the first label portion 312. Alternatively, if $L_2$ is greater than the circumference of container P, second segment 314***b* of second label portion 314 may be affixed to second label portion 314.

As shown in FIG. 4, in order to detach the first removable segment 314*a*, the end user may simply grasp and pull the tear strip 328 (which alternatively may or may not have adhesive on its bottom surface), thereby severing the tear strip from the first and second segments 314*a*, 314*b* along perforations 324, 326. Thereafter, the user may grasp and pull the first segment 314*a* to sever it from the first label portion 312 along perforation 322. At this stage, the area of the first label portion 312, as well as any area of second label portion 314 previously covered by the first label segment 314*a* of the second label portion 314 may be exposed. Also, the detached first label segment 314 may perform an additional function, for example, as a redeemable coupon, or the like. Additionally, tack adhesive 120 (not shown in FIG. 4) may be added to the bottom surface of segment 314*a* in a fashion similar to that for labels 110 and 210, in order to provide a resealable means for segment 314*a*. Further, the first label segment 314 may perform an additional function, for example, as a resealable segment.

Figure 7:
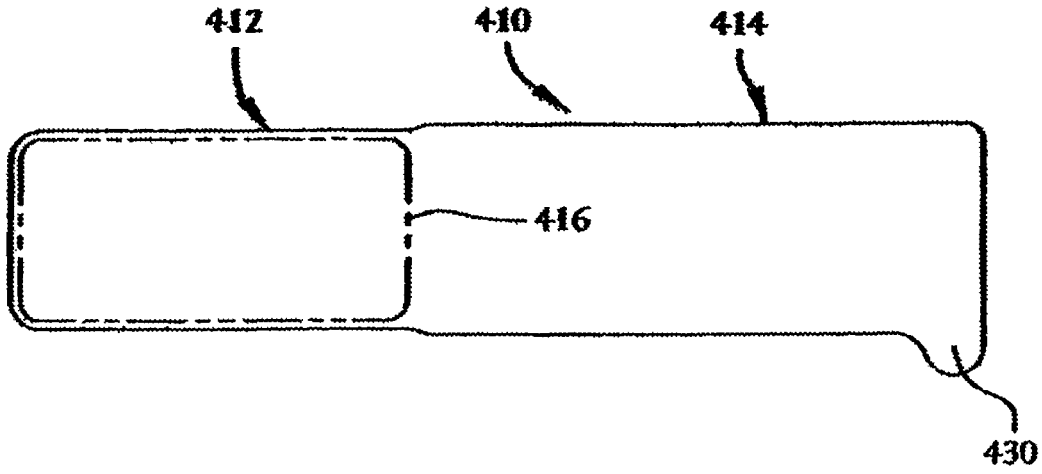
FIGS. 7, 8 and 9 are top plan views of labels according to the present invention including means for facilitating separation of a second portion of the label from a first portion thereof.
Figure 8:
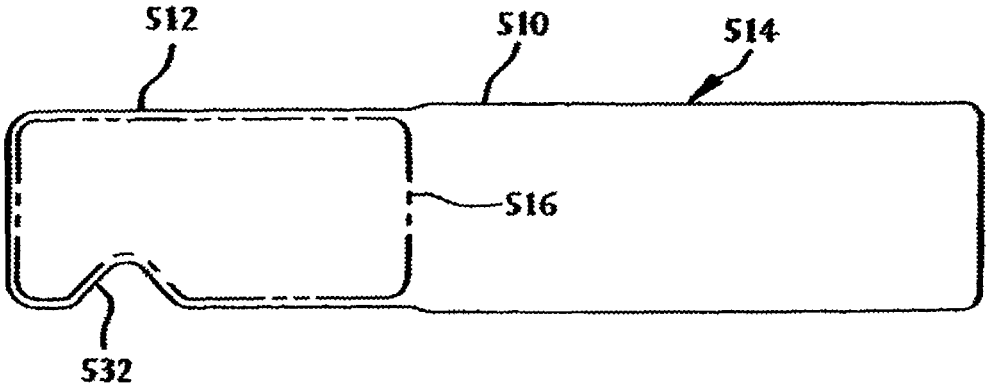
Figure 9:
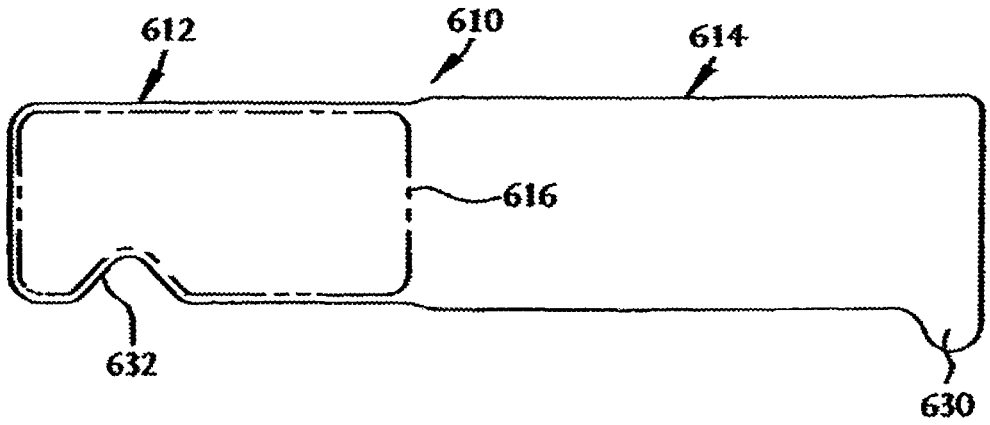

FIGS. 7, 8 and 9 illustrate further embodiments of a label constructed according to the present invention, identified respectively by reference numerals 410, 510, and 610. It should be understood that labels 410, 510, and 610 may be constructed substantially similarly to any of the label embodiments disclosed herein, including, but not limited to, labels 110, 210, and 310 described above, or label 710 as discussed below.

More particularly, labels 410, 510, and 610 may depict exemplary separation of the releasable second portions of the labels from the first portions thereof, when the labels are secured to objects, such as products or product containers. These means may include a protrusion 430 provided adjacent to a distal end of the second portion 414 of label 410, a notch 532 adjacent to an end of the first portion 512 of label 510, or a combination of a notch 630 adjacent to a distal end of second portion 614 and a notch 632 adjacent to an end of the first portion 612 of label 610. Each of these means may enable easier insertion of a user's finger or fingernail beneath the releasable second portion of any of the labels herein described when such labels are affixed to a product or product container whereby the second label portion may be more easily lifted and separated from contact with the first label portion.

Figure 10:
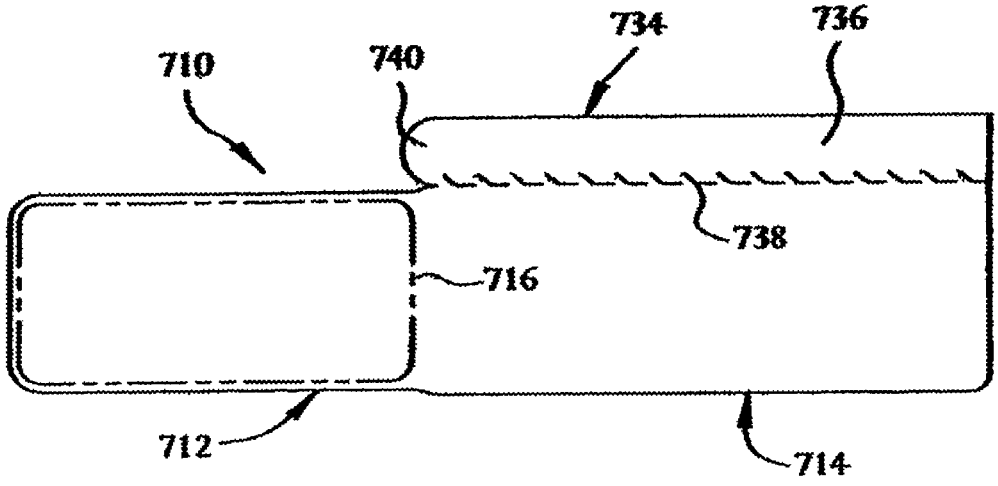
FIG. 10 is a top plan view of a further embodiment of a label constructed according to the present invention having a tear strip.
Figure 11:
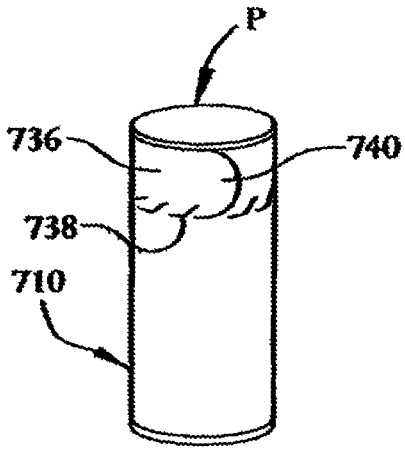
FIG. 11 is a perspective view of the label of FIG. 10 shown wrapped about the circumference of a substantially cylindrical product container.
Figure 12:
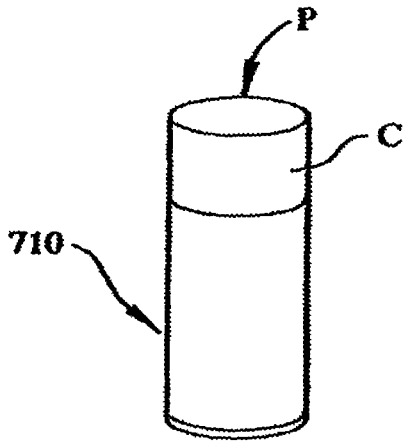
FIG. 12 is a perspective view similar to FIG. 11 with said tear strip removed.

FIGS. 10, 11, and 12 reveal a further embodiment of a label 710 constructed in accordance with the present invention. Label 710 may be manufactured in a substantially similar manner to and/or may incorporate any combination of the features of previously described labels 110 through 610. Label 710 may include means 734 for evidencing tampering of product prior to any consumption thereof by an end user. In addition to the tampering means discussed in these exemplary embodiments, it will be apparent to those skilled in the art in light of the disclosure herein that any tampering means may be operable with the present invention. In one embodiment of the present invention, tamper evident means 734 may comprise a fixed or disposable tear strip 736 contiguous with either the first, the first and second, or, as shown, the second portion 714 of label 710 along perforation 738. Tear strip 736 may be of any length, though typically may correspond to the length of the circumference of C as shown in FIG. 12.

FIG. 11 shows label 710 as it would appear when affixed to the circumferential side wall of a substantially cylindrical product container P. To assure its attachment to the product container prior to removal, all or a portion of the tear strip 736 may be provided with a pressure sensitive or other suitable adhesive. When it is desired to access the contents of container P, the end user may simply lift a distal end flap 740 of the tear strip 736 and pull the strip away from the remainder of the label 710 such that the strip detaches from the label along perforation 738. Upon removal, the tear strip may be discarded.

Once tear strip 736 is removed, the product container cap or lid C may be exposed, thereby enabling the user to remove the cap and access the contents of the product container P. However, should the end user discover that, prior to purchase or use, tear strip 736 is missing or damaged, tamper evident means 734 may alert the user that consumption of the contents of product container P should be avoided.

Alternatively, distal end flap 740 may be omitted from tear strip 736. Tear strip 736 may be temporarily or permanently affixed to cap C, and instead of the end user tearing away tear strip 736, the end user may remove cap C by twisting or pulling, thereby breaking perforation 738 and alerting a subsequent user that the container had been previously opened or otherwise tampered with. In this embodiment, tear strip 736 may either be removed from or remain attached to cap C.

Figure 18:
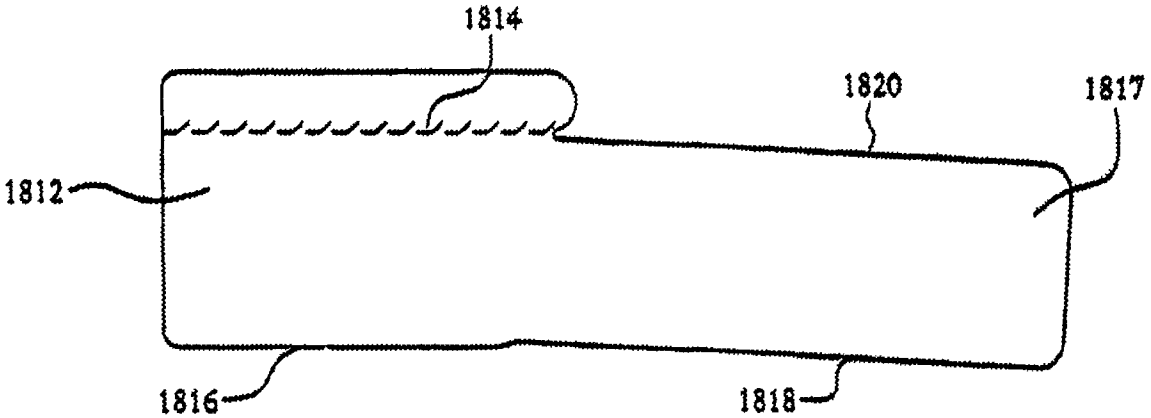
FIG. 18 is a top plan view of a further embodiment of a label constructed in accordance with the present invention.

Referring now to FIG. 18, there is shown a product label 1800 constructed in accordance with the present invention. Label 1800 is essentially identical to the label shown in FIG. 10, except that label 1800 may be adapted for application to irregularly shaped objects, such as, for example, tapered objects. However, as is the case with any of the exemplary labels discussed hereinthroughout, the additional features of label 1800 may be applied to any of the labels of the present invention as described herein. Label 1800 may have a first portion 1812 with a top edge 1814 and a bottom edge 1816. The label 1800 may also have a second portion 1817 with a top edge 1818 and a bottom edge 1820. To accommodate application to a tapered object having a top with a larger circumference than the bottom, the top edges 1814 and 1820 may be longer than the corresponding bottom edges 1816 and 1818. In addition, the first portion 1812 may be oriented at an oblique angle relative to the second portion 1817. The relative length of the top and bottom edges and the angle between the first and second portions depend upon the shape and size of the article to which the label is to be applied. Generally, the greater the taper of the article, the greater the angle and the greater the difference between the length of the top and bottom edges, and vice versa. The specific lengths and angle may be selected so that the second portion 1817 substantially precisely overlaps the first portion 1812 when the label 1800 is wrapped more than 360° around an article. Alternatively, the specific lengths and angle may be selected so that the second portion 1817 only partially overlaps the first portion 1812 and partially contacts the container when label 1800 is wrapped more than 360° around an article. Some or all of the edges may be curved to accommodate the difference in length between the top edges and the bottom edges. In FIG. 18, the top edge 1820 of the second portion 1817 may be curved. In another alternative embodiment, the second portion may comprise one or more sub-sections, wherein each sub-section may be at an angle relative to the adjacent preceding sub-section and the angle may be selected to fit the geometry of the object to which the label is to be applied.

As mentioned above, the label(s) of the present invention as discussed hereinthroughout may be comprised of a flexible and printable substrate such as paper or plastic (such as, for example, polyvinyl chloride, polyethylene or polypropylene) sheet or web material. Although each label may be made individually, labels are preferably produced in larger quantities from rolls of such substrate such as sheet stock which can be continuously printed, coated with adhesive, affixed to release paper, and cut to produce multiple labels. One or more areas or surfaces of the label may also be coated with a lacquer or varnish in order to protect the label and/or printed inks from wear or other degradation.

In one embodiment of the present invention, a reactive composition, such as a laser reactive varnish, may be used to overcome the limitations of the prior art by adding printable space to the labels of the present invention. For example, such a reactive composition may be used to not only protect printed inks prior to addition of the varnish, but also to add a lot number, expiration date, bar codes, 2D codes, graphics, logos and any other information independently of any other information pre-printed on the label prior to addition of the reactive varnish.

In an exemplary embodiment, a laser reactive varnish may be composed, in part, by a solvent, a binder and an oxyanion of a multivalent metal, which may undergo a color change due to a change in oxidation state when exposed to laser light. A pigment may also be included in the varnish.

The laser used to activate the varnish, or partially and in a targeted manner activate the varnish, may be a low energy laser, such as a C $O_2$ laser operating at a wavelength of approximately 10,600 nm. The laser used may also operate in a dot matrix mode, continuous-wave, scribing mode, or any other mode suitable for printing on a label or label attached to a container or other item, preferably without damaging pre-printing or the container itself.

The substrate to which the varnish may be applied may be a label, or any substrate suitable for a label as described herein. If a multi-layer material is used, the printing may occur at whatever layer the laser reactive composition is present, or may occur at multiple levels dependently upon the strength of a laser or lasers to uniquely excite the varnish at each of the multiple levels.

The oxyanion of the laser reactive compound may be, for example, a molybdate, tungstate or an analgous transition metal compound. Such compounds may further include di- and hepta-molybdates. The solvent may be, for example, water, ethanol, ethyl acetate, isopropyl alcohol, hydrocarbons or any other solvent commonly used for inks and varnishes. The binder may be a polymer, including acrylics, celluloses and polyesters, for example. The binder may also include a labile group, such as hydroxyl, acetoxy, ether acetal or halogen.

As mentioned previously, organic and inorganic pigments, such as $CaCO_3$, ZnO, $TiO_2$ and talc, for example, may be incorporated into the varnish without any adverse effect on the laser printing of the exemplary laser-reactive varnish. Any color pigment may be used, such as, for example, a white pigment, which may provide opacity as well as contrast with a dark colored lot number or barcode. The amount of pigment used within the varnish may vary, as the color and resolution of any images produced may be dependent on the density of the pigment found within the varnish. Additionally, other forms of reactive varnishes, including any of those commercially available, may be incorporated with the present invention.

A formulation of the varnish of the invention may include other components, such as material that absorbs incident laser light, and/or may itself change color upon absorption, or may react with another material to provide the desired color change. Examples of such materials may be phenols, phenolic resins, carboxylic acids in combination with a color former, clays, micas, $TiO_2$, carbonates, oxides, talc, silicates, and aluminosilicates.

Images produced via the laser reactive varnish may be applied to the label at any point in the manufacturing or assembly process of the label itself, or the container or item to which the label will be attached to. For example, a lot number or expiration date may be added to the label once the container has been sealed, the label attached, and any tamper evidencing mechanism has been applied. In another example, a bar code may be added to the label before the label is attached to its intended container or item.

Also, as an alternative to the protective lacquer or varnish, an additional layer of protective material (for example, a substantial transparent layer of plastic such as polyvinyl chloride, polyethylene or polypropylene) may be applied to select surfaces or areas of the label. The means by which the labels will be made will depend, in part, upon the features which are to be incorporated into such labels. A laser may be used to activate the varnish before activation of such protective layer, or the laser may be tuned to pass through the protective layer to activate the reactive varnish after application of the protective layer.

It should be understood that the reactivity of the varnish discussed herein is not limited to laser reactivity. For example, the reactive varnish may be activated using microwaves, chemical reactants, ultraviolet lighting, or other means that may be apparent to those skilled in the art, in light of the disclosure herein. The composition of the reactants in the varnish will, of course, vary based on the activator used and based on any intervening process steps that precede the activation of the varnish.

Figure 13:
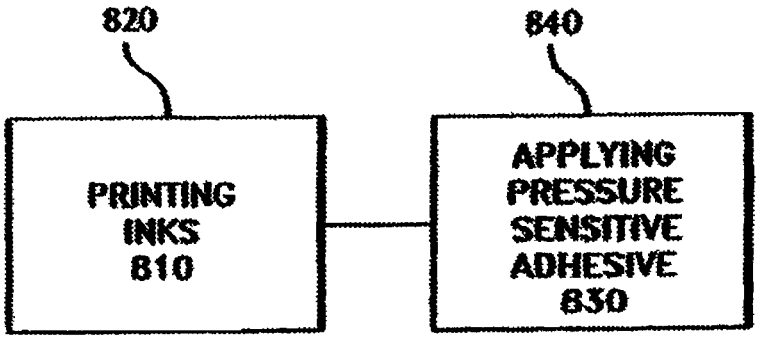
FIG. 13 is a schematic depicting a method for making the labels of this invention.

Referring to FIG. 13, there is shown a schematic depicting a method for making labels. It should be noted at the outset that the order in which the steps of the methods herein disclosed are carried out is not necessarily critical. As mentioned above, the labels are made from a flexible and printable substrate 800. Graphic or other inks 810 may be printed by printing step 820 (for example, by flexographic, rotogravure, silk screening or other printing methods) at predetermined locations on the top and/or bottom surfaces of substrate 800.

For example, depending on the desired or necessary label configuration, inks 810 may be applied to: the top surface of first label portion 112, 212, 312, 412, 512, 612, or 712; the top surface of second label portion 114, 214, 314*a*, 414, 514, 614, or 714; and/or the bottom surface of second label portion 114, 214,314, 414, 514, 614, or 714. Pressure sensitive adhesive 830 may be applied by step 840 (e.g. hot melt or other adhesive means) to predetermined locations on the bottom surface of substrate 800 so as to provide a means by which the label may be affixed to the desired object. For example, depending on the desired or necessary label configuration, pressure sensitive adhesive 830 may be applied to the bottom surface of the first label portion 112, 212, 312, 412, 512, 612, or 712.

Figure 14:
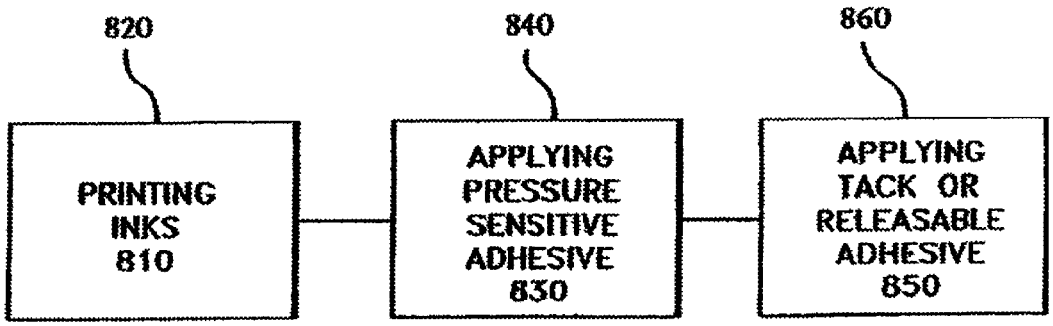
FIG. 14 is a schematic depicting a further method for making the labels of this invention.

FIG. 14 depicts a method for making the labels of this invention, which adds to the steps shown in FIG. 13 optional step 860 for applying tack or resealable adhesive 850 to select locations on substrate 800, such that the second label portion may be selectively and repeatedly adhered to the first label portion. For example, depending on the desired or necessary label configuration, tack or resealable adhesive 850 may be applied to the distal edge of the bottom surface of first label portion 112 (i.e. 118), 212, 312, 412, 512, 612, or 712.

Figure 15:
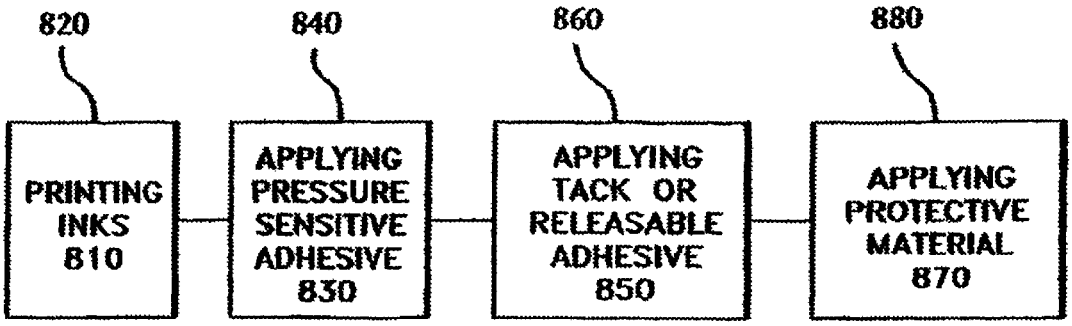
FIG. 15 is a schematic depicting yet a further method for making the labels of this invention.

FIG. 15 depicts a method for making the labels of this invention, which may add to the steps shown in FIG. 14 optional step 880 for applying a protective material 870 to select locations over substrate 800 and/or inks 810 in order to protect substrate 800 and/or inks 810 from wear or other degradation. For example, depending on the desired or necessary label configuration, protective material 870 (e.g. lacquer, varnish, PVC, or other substantially transparent protective material) may be applied to any surface. In addition, it should be noted that either adhesive 830 or 850 may be applied over protective material 870, provided that such application does not cause an adverse chemical reaction.

Figure 16:
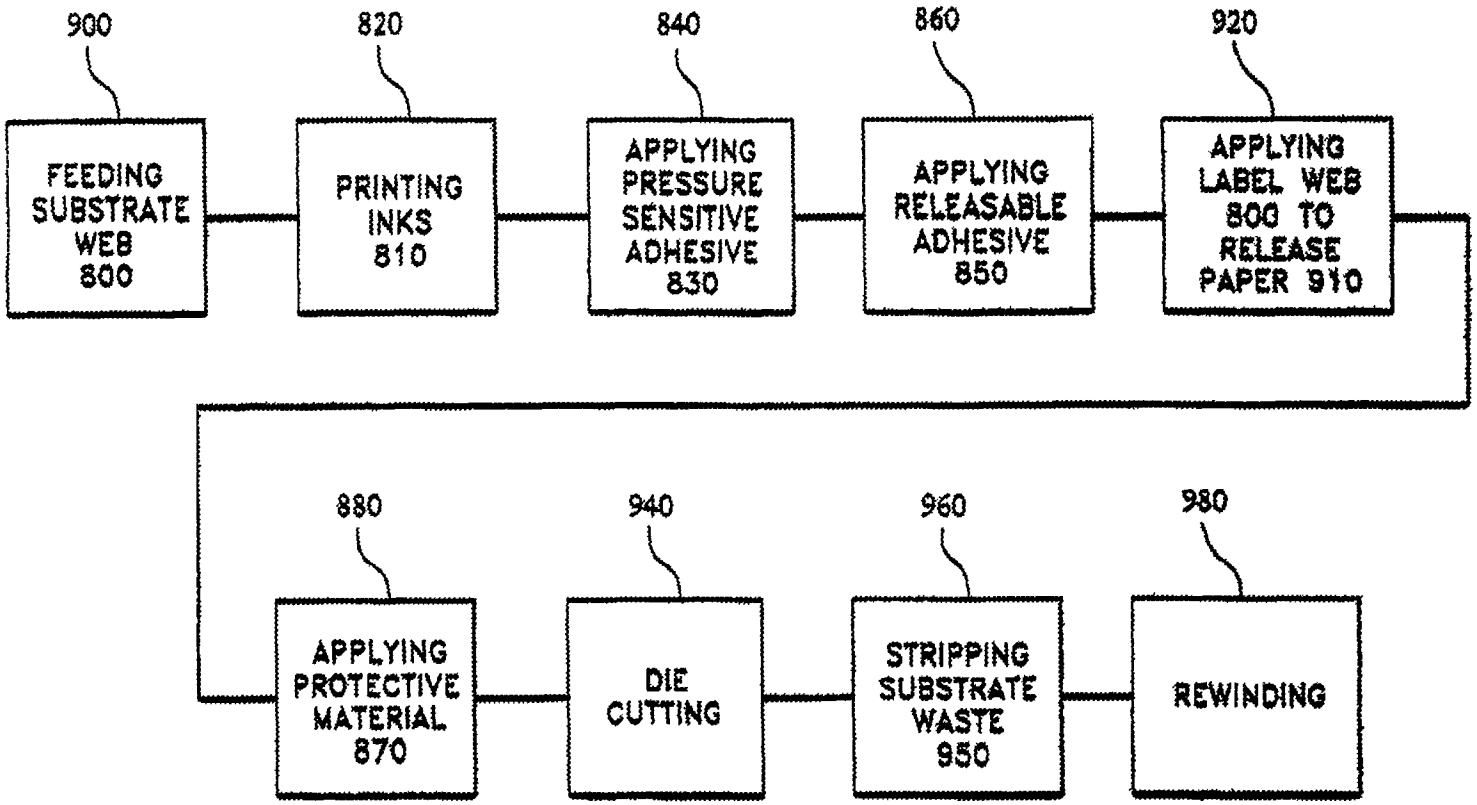
FIG. 16 is a schematic depicting yet another method for making the labels of this invention.

FIG. 16 depicts a method for making the labels of this invention, which may add additional optional steps to the steps shown in FIG. 15. In this embodiment, substrate 800 may be in the form of a web in order to facilitate the production of larger quantities of labels. Specifically, in step 900, substrate web 800 is fed through a series of process steps. Each such step is represented schematically by a box in FIG. 16.

As indicated above, the order in which the steps are carried out is not necessarily critical to the successful manufacture of the labels of the present invention. With this in mind, inks 810 may be printed on one or both sides of web 800 in printing step 820. Pressure sensitive adhesive 830 may be applied to select areas of web 800 in application step 840. Resealable adhesive 850 may be applied to select areas of web 800 in application step 860. A surface of web 800 bearing pressure sensitive adhesive 830 may be applied to release paper 910 in application step 920, such that the resulting labels produced from this process may later be removed for application to container P. In application step 880, protective material 870, which may include a lacquer, a varnish, and/or a reactive varnish, such as an ultra violet varnish, a chemically reactive varnish, or a laser reactive varnish, PVC, or any other at least partially transparent protective or reactive material, may be applied to select surfaces of web 800, which surfaces may or may not contain pressure sensitive adhesive 830. In die cutting step 940, substrate web 800 (along with any protective material 870) may be die cut to form label blanks, perforations, and/or other openings (if any) in web 800. In stripping step 960, substrate waste 950 may be removed from release paper 910 after die cutting step 940, thereby leaving finished label blanks releasably adhered to release paper 910 for later application to container P. Finally, in optional rewinding step 980, release paper 910 bearing die cut label blanks may be wound into rolls or other convenient form for later application of the resulting labels to container P or other objects by manual or automated means.

Figure 17:
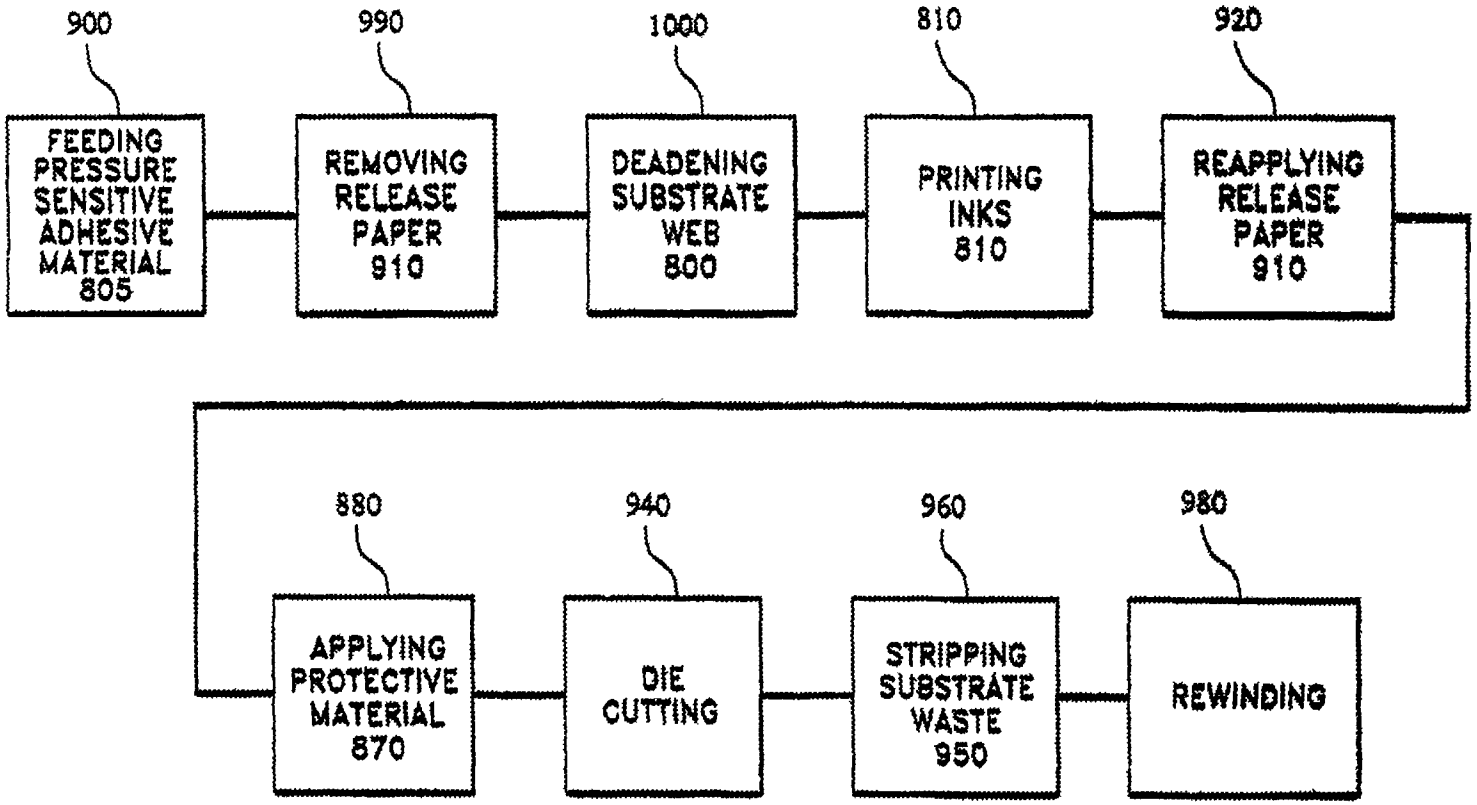
FIG. 17 is a schematic depicting another method for making the labels of this invention.

FIG. 17 depicts another method for making the labels of the present invention, which method is similar to the method set forth in FIG. 16, except that substrate web 800 may be replaced with a pressure sensitive adhesive (PSA) material 805. PSA material 805 may comprise substrate web 800 releasably adhered to release paper 910 by pressure sensitive adhesive 830, which adhesive 830 may be typically coated on one side of web 800. In step 900, PSA material 805 may be fed through a series of process steps. Each such step may be represented schematically by a box in FIG. 17. Again, the order in which the steps of this method are carried out is not necessarily critical to the successful manufacture of the labels of this invention. With this in mind, in step 990, release paper 910 may be removed from PSA material 805 to expose pressure sensitive adhesive 830.

As discussed above, in certain embodiments of the labels of the present invention, it may be desirable to have certain portions of the label which are coated with pressure sensitive adhesive 830 (see e.g. portions 116, 216, and 316 of FIGS. 2 through 4, respectively, and portions 416, 516, 616, and 716 of FIGS. 7 through 10, respectively) in certain areas which may be intended to be indicia or ink bearing surfaces (see e.g. second portions 114, 214, and 314 of FIGS. 2 through 4, respectively, and 414, 514, 614, and 714 of FIGS. 7 through 10, respectively). When PSA material 805 is provided with pressure sensitive adhesive 830 in areas where it may be necessary or desirable to print indicia or inks 810, such areas may be "deadened" by either removing pressure sensitive adhesive 830 from web 809, or by applying a detackifying material, such as a varnish, laminate or other material capable of providing a suitable surface for the printing of indicia or inks 810. This deadening process may be particularly useful when it is necessary or desirable to print on the surface of web 800, which surface also bears pressure sensitive adhesive 830 (see e.g. surface 118 of FIG. 5).

The deadening process (if any is required) may be carried out in step 1000. With PSA material 805 prepared, web 800 may be printed with inks 810 on any surface of the label which is suitable for accepting inks 810, Such printed surfaces may include both top and bottom surfaces of the label being produced, any surface not bearing pressure sensitive adhesive 830, or any surface which has been deadened in step 1000. Printing step 810 may comprise one or more steps wherein the top and bottom surfaces of the label may be printed either simultaneously or in separate steps. In one embodiment of the invention, inks 810 may printed on the top surface of the PSA material 805. PSA material 805 may be turned over, and inks 810 may be printed on the bottom surface of PSA material 805.

In step 920, release paper 910 may be reapplied to web 800 with pressure sensitive adhesive 830. Reapplication step 920 may occur at any time after printing step 810 is completed with respect to the surface of the label which also bears pressure sensitive adhesive 830.

As in the method depicted in FIG. 16, application of protective material 870 may take place in step 880, die cutting of individual labels takes place in step 940, substrate waste 950 may be stripped away in step 960, and the resulting web which bears the finished die cut label blanks may be rewound in step 980.

The present invention may also include labels which incorporate brochures or booklets for increasing the printable area of the label.

In one embodiment of the present invention, a brochure label may be resealable, that is, so constructed and arranged that opening or use of the brochure associated with the label does not render impossible resealing of the brochure. Thus, a resealable brochure label may be restored to its initial appearance and condition after having been opened. The brochure label may also be capable of neatly wrapping around the sharp or small radius corners of a square container, or any other shaped container. Thus the brochure portion of the present invention may provide for a smooth and highly pleasing wrap for the brochure.

Another desirable attribute in a brochure label may be the ease of opening and reseal-ability. The present invention may provide a simple and effective tab to facilitate opening, as well as capability of repeated resealing.

In some applications, it may be necessary or desirable that the graphics and other aesthetic aspects of the brochure be integrated with those of the products labeled, so as to provide a uniform appearance and appeal. In accordance with the present invention, the printing of the brochure component of a brochure label may be coordinated with that of the base label, using matched or coordinated materials or printing techniques, so that the base label and brochure provide the appearance of a unitary piece.

Finally, in some instances it is desirable that one or more leaves or pages of the brochure may be removable, or that provision be made for removeability of the entire brochure at the user's option. As is explained below, suitable structural features may be provided within the purview of the present invention to achieve these desirable ends.

Labels in accordance with the present invention may be delivered to users in roll form and applied to packages in the same manner, using the same equipment, and at satisfactory production speeds (generally in excess of 200 bottles per minute) as standard pressure sensitive labels.

Generally, the present invention may provide an adhesive label assembly which includes an integral brochure. The assembly may comprise of a pressure sensitive base label, adhesively and releasably supported by a flexible liner. The brochure may be associated with the base label (which may be any label as described throughout), and may be made up of a folded sheet providing panels, or pages, of the brochure. The brochure may be positioned to overlie at least a portion of the base label, and the top panel of the brochure may be made to project laterally beyond a lateral edge of the base label. The projecting portion of the top panel may provide a tab to facilitate opening of the brochure. A self-adhesive transparent overlayer may be provided over the upper surface of the base label and also the top panel of the brochure. The overlayer may be made to extend beyond an edge of the top panel, to facilitate sealing and resealing by adhesion of the overlayer to the container or other substrate to which the base label is applied or to a remote end portion of the base label. Alternatively, sealing and resealing of the overlayer may be accomplished by adhering the extended portion of the overlayer to a portion of the base label which extends beyond a bottom panel of the brochure. Regardless of the specific embodiment of the invention, the top panel may also provide a tab, which, in association with the projecting portion of the overlayer, provides both a means for sealing the brochure and a means for easily gripping the brochure to facilitate opening.

Optionally, perforations may be provided on one or more panels of the brochure, to facilitate ready removal of the page provided by that panel. Those skilled in the art will appreciate that the removed page may be or include a coupon, a premium, or a pre-printed request for additional information.

Optionally and alternatively, a line of perforations may be provided in the base label and overlayer, so that the consumer may remove the booklet without destroying the copy contained on the base label beneath it.

Figure 19:
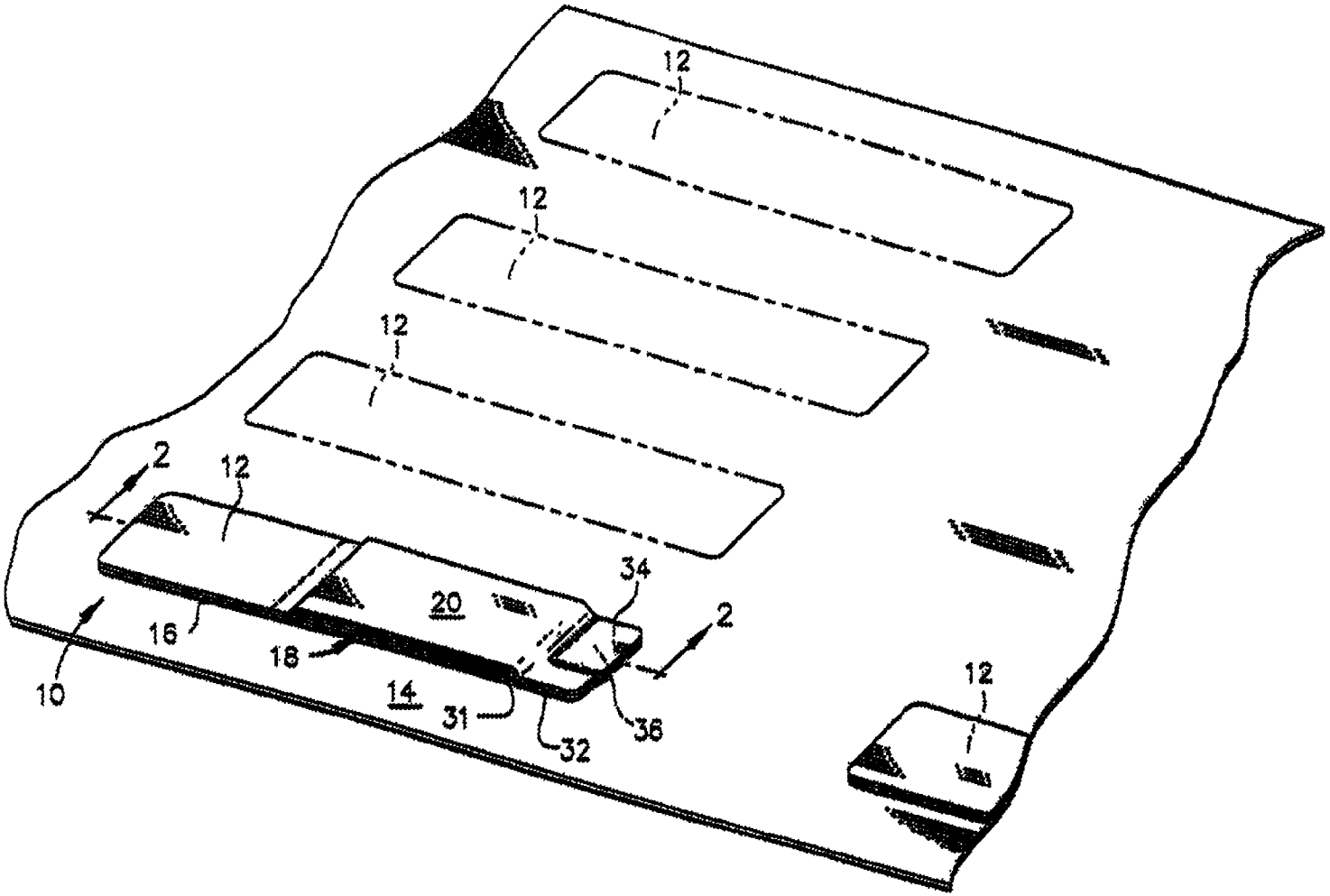
FIG. 19 is a pictorial view, in perspective, of a label assembly in accordance with the invention.

Referring now to FIG. 19 a label assembly is designated generally by the reference numeral 10. The label assembly 10 includes plural individual labels 12, disposed on a flexible liner 14. It should be understood that the thicknesses of the liner 14 and labels 12, as well as the various components which are laminated to make up the label 12, are exaggerated for clarity.

Figure 20:
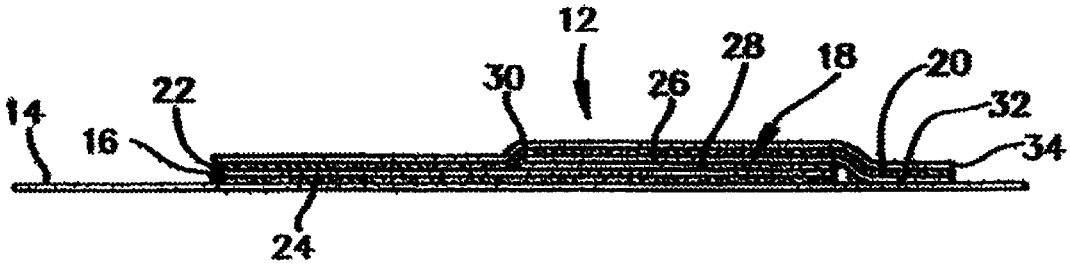
FIG. 20 is a cross-sectional view taken along the line 2-2 in FIG. 19.

Referring to FIGS. 19 and 20, an individual label 12 will be described in detail. The label 12 includes a base label 16, a brochure 18 and a transparent overlayer 20. Seen in FIG. 20 is an adhesive layer 22 by which the overlayer 20 is secured to the base label and the brochure 18 (and which, in turn, secures the brochure 18 to the base label 16), and an adhesive layer 24 which releasably secures the base label 16 to the liner 14.

The brochure 18 in FIGS. 19 and 20 may be a leaflet which has two leaves 26 and 28, separated by a fold line 30. The top leaf 26, it will be seen, is wider than the bottom leaf 28, and thus extends further from the fold line 30 than does the bottom leaf 28. Such extra width associated with top leaf 26 over bottom leaf 28 may allow for more easy wrapping of brochure 18 around a container because the extra width of top leaf 26 over bottom leaf 28 accommodates the difference in diameter between top leaf 26 and bottom leaf 28 when they are wrapped around a container. Such difference in diameter between top leaf 26 and bottom leaf 28 may be due to the thickness of brochure 18 or the thickness of bottom leaf 28 and top leaf 26. The greater the thickness of brochure 18 and/or the bottom and top leaves, the greater the difference in diameter between them may be when they are wrapped around a container. As brochure 18 is wrapped around a container, the leaves of brochure 18 that may be closest to the container may be prevented from buckling, warping, and/or wrinkling by making top leaf 26 wider than bottom leaf 28 to accommodate the difference in diameters that may exist subsequent to wrapping them around a container, as may be illustrated in at least FIG. 23. Top leaf 26 may be any amount wider than the bottom leaf 28 so as to allow bottom leaf 28 to remain flat and even when it and top leaf 26 are wrapped around a container together. In addition, top leaf 26 and bottom leaf 28 may have the ability to shift and slide against each other as they are wrapped around a container together, thereby allowing bottom leaf 28 to be flat and even after top leaf 26 and bottom leaf 28 are wrapped around a container.

Figure 21:
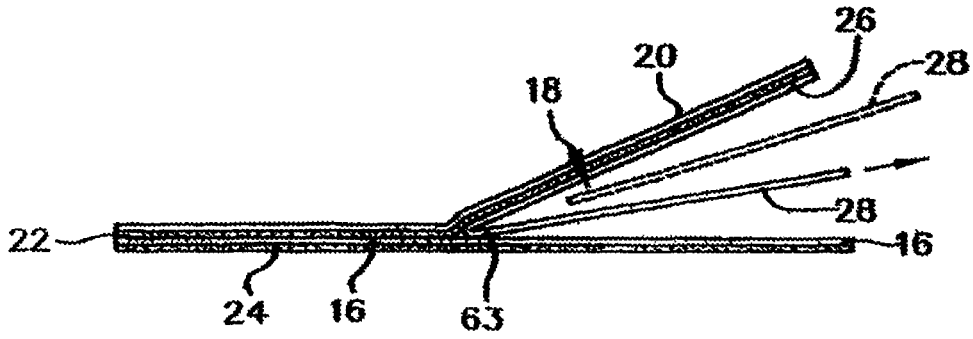
FIG. 21 is a cross-sectional view of a form of label in accordance with the invention.
Figure 23:
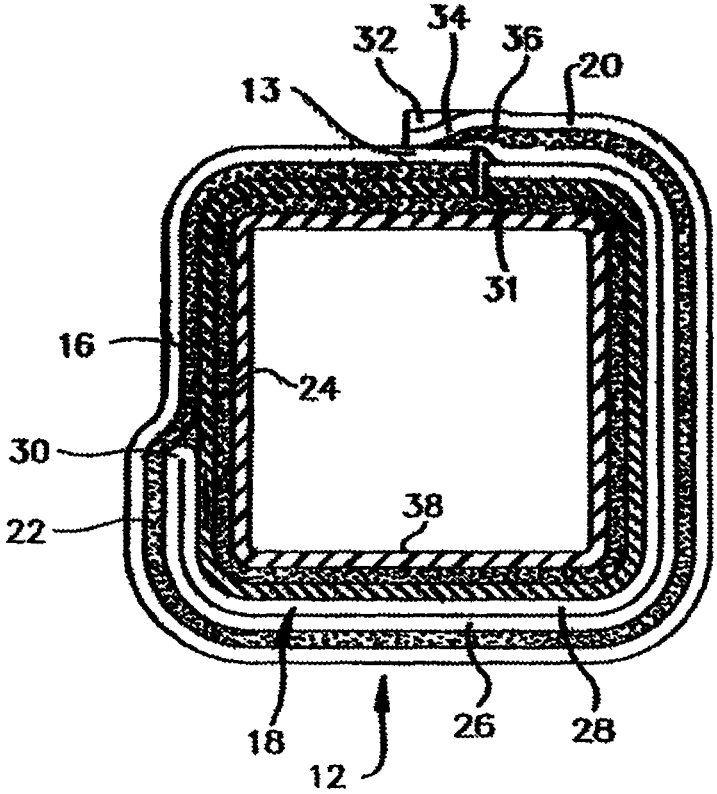
FIG. 23 is a top plan view, in cross-section, of an exemplary label in accordance with the invention, applied to a substrate in the form of a flat-sided container with small radius corners.

Furthermore, any other bunching, warping, buckling, and/or rippling of bottom leaf 28 as it is wrapped around a container with top leaf 26 may be prevented by allowing a gap to exist in the brochure structure between brochure 18 and layers 16, 22, and 20, as may be illustrated in, at least, FIGS. 21 and 23. Such gap may be of any size and may allow bottom leaf 28 more space to shift into position as bottom leaf 28 and top leaf 26 are wrapped around a container, thereby preventing bunching, warping, buckling, and/or rippling of bottom leaf 28. Such gapped fold region may allow bottom leaf 28 to lie flat and even on a container after it and top layer 26 are wrapped around a container.

Figure 32:
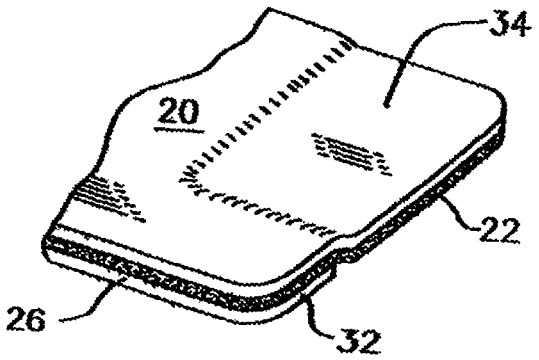
FIG. 32 is a detail view of a portion of a label in accordance with the invention.

A portion of top leaf 26 may extend beyond the lateral edge 31 of base label 16. As is perhaps best seen in FIG. 19 (and also in FIG. 32), a portion of the top leaf 26 is shaped to provide a tab 32, the purpose of which will be described shortly. As is also apparent in FIG. 19, a portion 34 of the overlayer 20 projects beyond a lateral edge 36 of the top leaf 26 in the vicinity of the tab 32, and is thus adhesively joined directly to the liner 14.

Figure 19A:
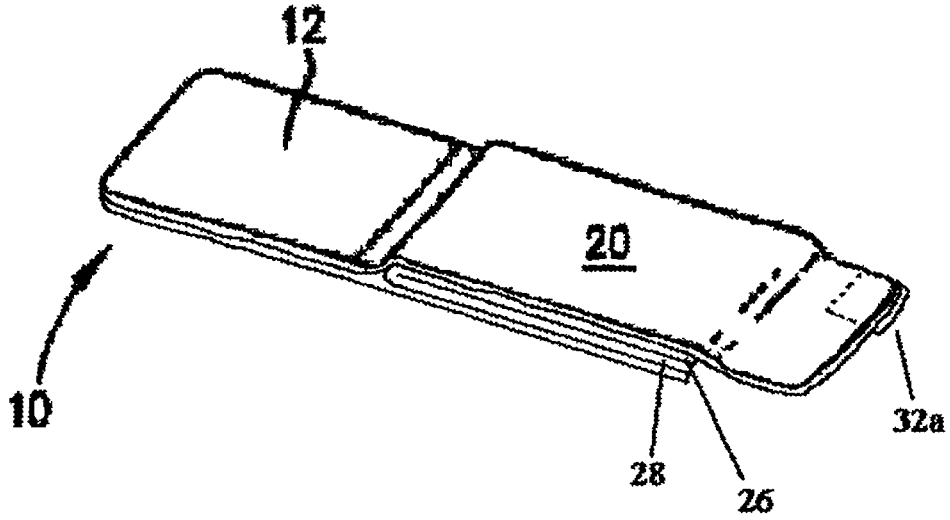
FIG. 19*a* is a pictorial view, in perspective, of a label assembly in accordance with an embodiment of the invention.

Another embodiment of the present invention is illustrated in FIG. 19*a*. In this embodiment, the lateral edge of top leaf 26 may end at the same point as the lateral edge of bottom leaf 28 such that top leaf 26 does not form a tab. In this embodiment, the lateral edge of top leaf 26 may line up with lateral edge of bottom leaf 28 such that neither top leaf 26 nor bottom leaf 28 overlaps the other at any point along that lateral edge. In this case, label assembly 10 may have a tab 32*a* of similar or same material as that used to create bottom leaf 28 or top leaf 26 situated under overlayer 20 wherein tab 32*a* is separate from both bottom leaf 28 and top leaf 26. Tab 32*a* may be shaped or sized in many different configurations in order to accommodate a specific purpose, as may be understood by those having skill in the art. For example, tab 32*a* may be shaped to fit one corner of the lateral edge of overlayer 20, as illustrated in FIG. 19*a*. In another example, tab 32*a* may be shaped to slightly protrude out from under overlayer 20 such that it provides enough length for someone to easily grasp it. In this embodiment of the present invention, the portion of overlayer 20 which extends beyond the lateral edges of top leaf 26 and bottom leaf 28 may provide an area for adhesive to exist such that, when label assembly 10 is affixed to a container, overlayer 20 and top leaf 26 may remain flush with the rest of label assembly 10.

The configuration of label assembly 10 in the above embodiment may be slightly modified in that the full length of the lateral edge of top leaf 26 may, alternatively, extend out from the lateral edge of bottom leaf 28. In this embodiment, the lateral edge of top leaf 26 may overlap and cover the lateral edge of bottom leaf 28. This configuration may provide additional space for printing on top leaf 26. Similarly, the same label assembly may be, again, slightly modified in that the full length of the lateral edge of bottom leaf 28 may, alternatively, extend out from the lateral edge of top leaf 26. In this embodiment, the lateral edge of bottom leaf 28 may be visible even though top leaf 26 may cover part of bottom leaf 28. This configuration may provide additional space for printing on bottom leaf 28.

Referring now to FIG. 23, the manner in which a label such as the label 12 may be affixed to a substrate in the form of a container 38 is shown. In the example shown in FIG. 23, the container 38 is a round cornered square container. The label 12 wraps completely around the circumference of the container 38, without any bunching or buckling of the brochure 18 at the corners. This desirable result is achieved because, as described above, the top leaf 26 of the brochure 18 and the portion 34 of the overlayer 20 extend beyond the lateral edge 31 of the base label 16. In such an arrangement, the top leaf 26, with its associated overlayer 20 can be drawn tightly and smoothly during application of the label 12 to the container 38, thus enabling the adhesive 22 of the portion 34 to self-adhere (in the illustrated example) to a terminal portion 13 of the label 12. In other applications, such as the one shown in FIG. 24 (in which elements corresponding to those already described are designated by like, primed ('), reference numerals), the adhesive 22' of a portion 34' may adhere directly to a container 38'.

The tab 32 facilitates opening of the brochure, because it is interposed between the adhesive 22, 22' and, as the case may be, the terminal portion 13 of the label 12 or the container 38'. The tab 32 thus provides a convenient "handle" and an aid to opening of the brochure. On the other hand, the adhesive 22, 22' on the portions 34, 34' facilitates repeated resealing of the brochure as the contents of the containers 38, 38' are used.

Figure 24:
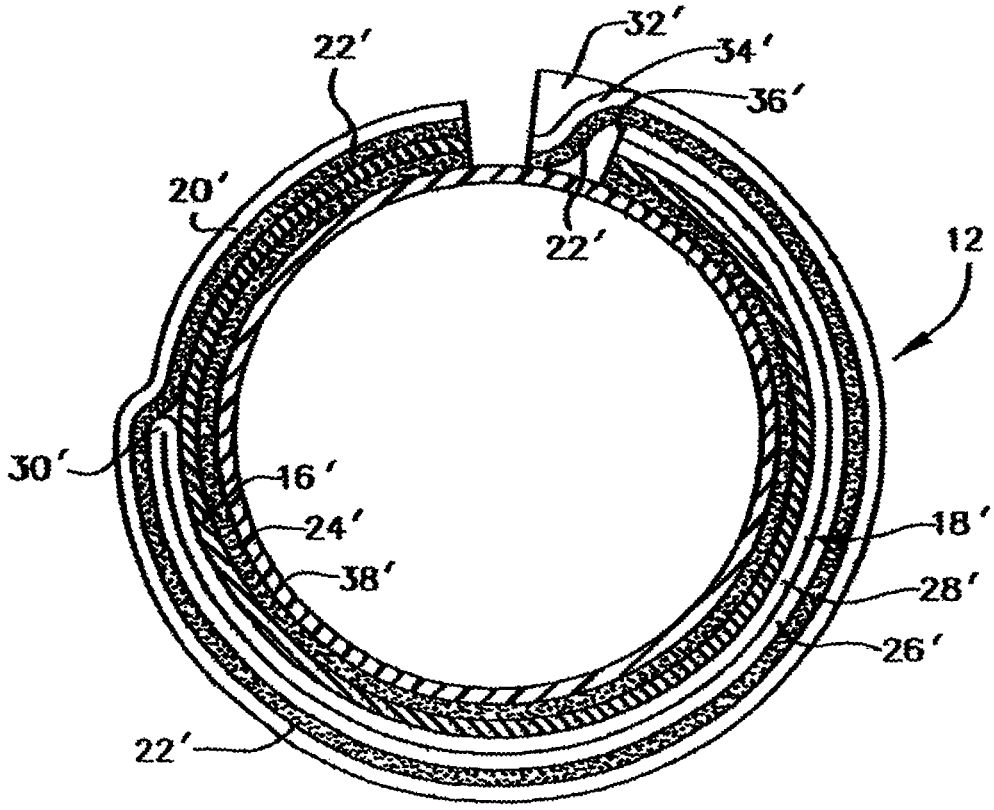
FIG. 24 is a top plan view similar to FIG. 23, also in cross-section, of another exemplary label in accordance with the invention, applied to a substrate in the form of a container of round cross-section.

It should be understood that the embodiments seen in FIGS. 23 and 24 are illustrative, and that a label applied as shown in FIG. 23 may be used to advantage on a round or otherwise shaped container or substrate, such as the round container 38 shown in FIG. 24. Similarly, a label may be applied as shown in FIG. 24 to a square or rectangular container, such as the container 38 of FIG. 23.

The stock from which the base labels 16 are made has been described in detail above, and is also commercially available and familiar to those skilled in the art. It generally comprises a layer of paper, peelably joined by pressure sensitive adhesive to a liner of flexible plastic polymeric film.

The material for the overlayer 20 is also commercially available, and may comprise a flexible clear plastic polymeric film, coated on one face with a clear pressure sensitive adhesive (which provides the adhesive 22, 22'). The top surface of the overlayer 20 may be treated in a known manner (as by having on it a release agent) to facilitate release and to avoid co-adhesion failure. All or a portion of the base label, the underlayer, or the brochure pages may be treated with the reactive varnish, and may be activated as discussed hereinabove. In a preferred embodiment the treatment with reactive varnish may occur in such a way as to not unintentionally seal the overlayer or the pages together or to the base layer.

In still another of its aspects, the invention provides a method of making an adhesive label assembly of the kind having an integral brochure. The method includes steps of: providing a pressure sensitive base label web comprising a base label sheet and a flexible liner releasably secured to the base label sheet; die cutting through the base label sheet but not the liner to form a blank for at least one and preferably two or more base labels; and stripping from the liner the material of the base label sheet other than the blank. Next, a brochure blank assembly, printed to provide multiple brochures, may be mated to the base label web and so positioned that a top panel of the assembly projects laterally beyond what will be the lateral edge of the base label. Alternatively, at least a portion of the base label may also extend beyond a bottom panel of the brochure. Next, there may be applied over the liner, brochure blank assembly and base label an overlayer of self-adhesive material, the self-adhesive material serving to secure the brochure blank assembly to the base label blank and also adhering to the liner adjacent to the tab portion. Alternatively, where the base label extends beyond the bottom panel of the brochure, the overlayer self-adhesive material may serve to secure the brochure blank assembly to the base label and also adhere to the extended portion of the base label.

Optionally, brochure blank assembly may be affixed to the base label by a suitable adhesive or by other affixation means. Die cutting through the overlayer and stripping of the waste yields the desired label assembly, with the individual labels releasably secured to the flexible liner.

Label assembly 10, as described above herein, may be versatile in that it may be shaped to accommodate many different sizes and styles of containers and packages. For example, overlayer 20, top leaf 26, bottom leaf 28, and base layer 16 may be all different sizes as is necessary to accommodate the shape of the container or package to which is may be affixed.

Figure 24A:
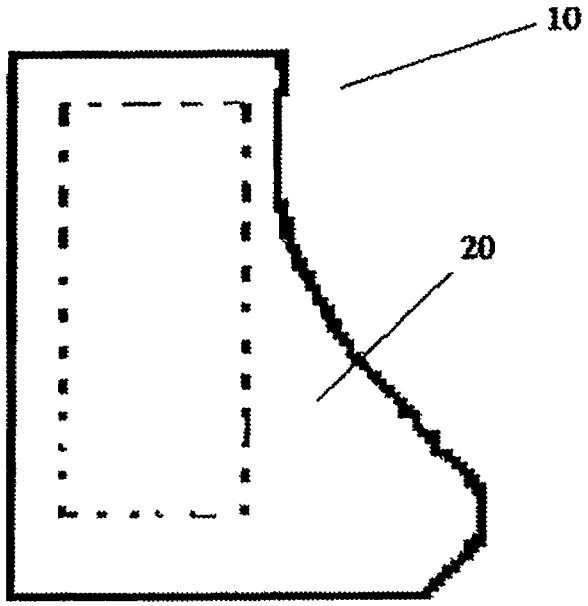
FIG. 24*a* is a top plan view of a further embodiment of a label constructed in accordance with the present invention.

Additionally, overlayer 20 and top leaf 26 may be longer or wider than the layers underneath them, which also may provide more space on top leaf 26 for printing or graphics. One configuration of one variation of label assembly 10 is illustrated in FIG. 24*a*. In this embodiment, label assembly 10 may be designed to accommodate a bottle having at least one flat side and a bottom portion that is wider than its top portion. In this example, overlayer 20 and the top leaf of label assembly 10 may be curved and shaped on the right side in order to cover a container that is wider and curved on its bottom portion. In this example, the wider part of label assembly 10, which includes the label's top leaf, may provide more area or space in which to print or apply graphics. Furthermore, brochure sheets (the first of which may be illustrated in FIG. 24*a* by dotted lines), which may underlie the top leaf and overlayer 20, may be shaped in traditional rectangular or square patterns so as to keep manufacturing costs lower for the leaflet portion of label assembly 10. In addition, it is to be understood that, although the embodiment illustrated in FIG. 24*a* represents one configuration, a limitless number of alternative configurations exist for different sizes and shapes of the top leaf and the overlayer of label assembly 10 such that it would not be possible to describe all of them herein. Thus it is to be understood that the top leaf, the bottom leaf, the overlayer, and the brochure sheets all may be of various sizes and shapes to accommodate various shapes and sizes of containers and packages to which they may be affixed.

Referring now to FIGS. 19 and 25-31, a method of making an adhesive label assembly in accordance with the invention will be described.

The brochure blank assembly may be prepared in full web width. A base label may be printed, also in full web width. Next, the base label may be die cut from a base label web 42, and excess may be stripped to base label blanks, each blank ultimately providing, in the presently preferred form of the method, two base labels. Next, the brochure blank assembly 40 may be brought together with the die cut and stripped base label web, and a pressure sensitive overlayer 20 may be applied over the exposed liner 14, the base label and brochure blank assembly, joining in the process the base label and brochure. No glue is necessary to assemble the base label and brochure, although glue may optionally be used in some embodiments. Finally, the assembled base label, brochure and overlayer may be die cut to the final outline of the label, and waste may be stripped to yield the final label assembly.

Figure 25:
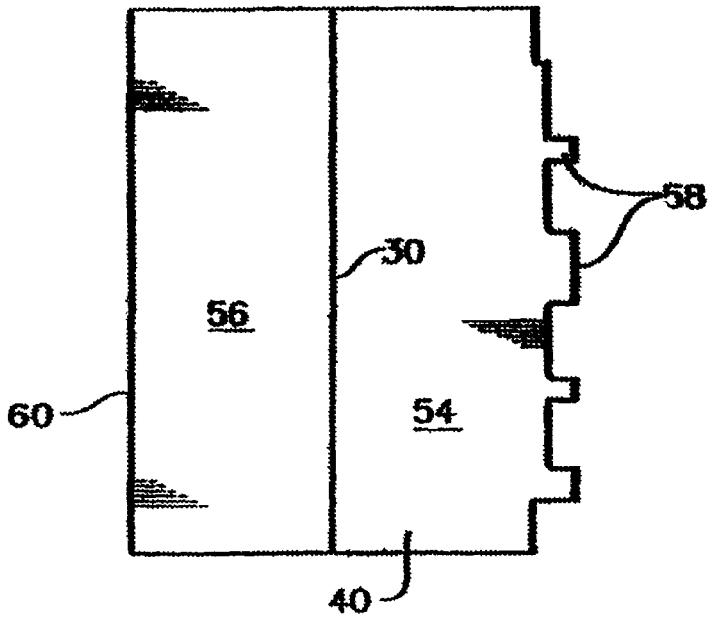
FIG. 25 is a plan view of a brochure blank for use in the invention.

Referring now to FIG. 25, the brochure is printed by any suitable process, in the presently preferred process by sheet-fed offset printing in full web width (typically about twelve inches). Each sheet may contain multiple repetitions width wise. One presently preferred form of the process prints four wide. The portions of the blank assembly 40 which, with further trimming, may ultimately form the above-mentioned tabs 32, may be die cut, although other techniques may occur to those skilled in the art. Such method step of die cutting wherein tabs 32 are cut in one step may allow tab-making costs to be reduced, as tabs 32 may not need to be individually cut from separate materials and separately attached to blank assemblies 40. In addition, such die cutting step may allow less material or web to be used, which may allow costs to be lowered further. The sheet may then be trimmed to size and folded as desired, as at fold line 30 in FIG. 25.

Figure 27:
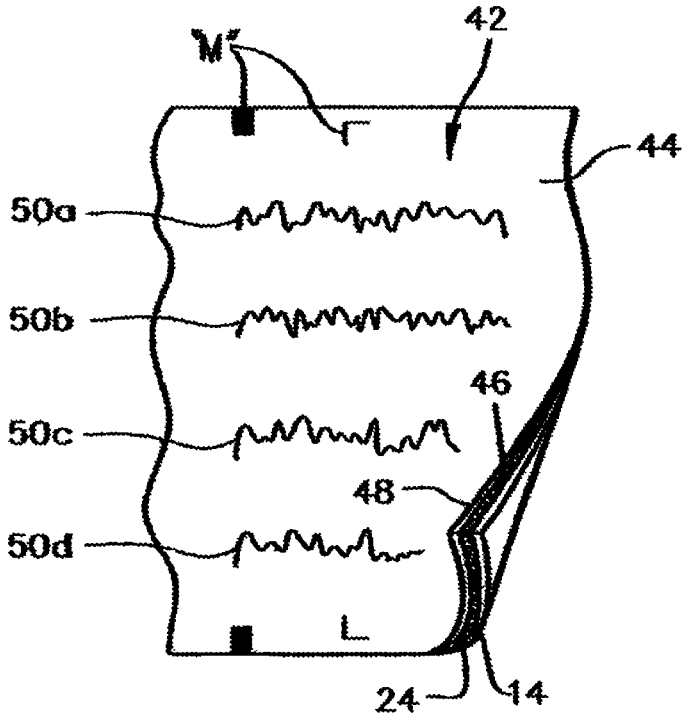
FIG. 27 depicts a portion of a base label web as used in the invention.

Referring now to FIG. 27, a base label web, designated generally by the reference numeral 42, a portion of which is seen in the Figure, is provided. The base label web is comprised of a base label sheet 44, of paper or other suitable material and liner 14 releasably adhered to the base label sheet 42. The base label web 42 has respective lower 46 and upper 48 faces, and has on its lower face a continuous layer 24 of adhesive which provides the above-mentioned adhesive layer 24 in the finished product. Printed matter suitable to the intended finished product may be applied to the upper face 48 of the base label sheet 44 by any suitable printing process. Suitable eye and machine-readable positioning, "eye" and registration marks "M" may also be printed on the base label sheet 44, to facilitate joining of the brochure blank assembly 40 with the base label web 42 (as described below) and other automated process steps. As is apparent in FIG. 27, printing of the base label sheet 44 may be done in full web width, providing multiple repetitions across the width of the web. The illustrated example provides four repetitions designated in the Figure as 50*a-d*.

Figure 28:
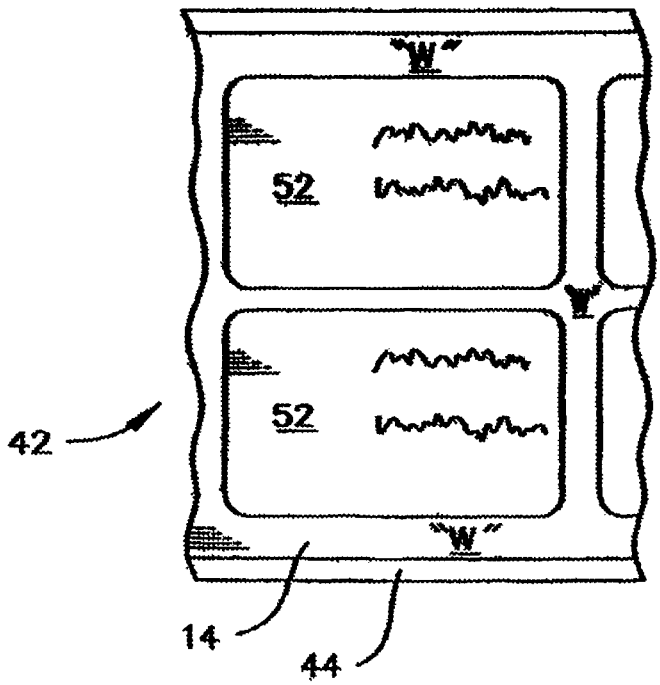
FIG. 28 depicts a base label web, die cut prior to stripping waste, to provide intermediate blanks for base labels in accordance with the invention.
Figure 29:
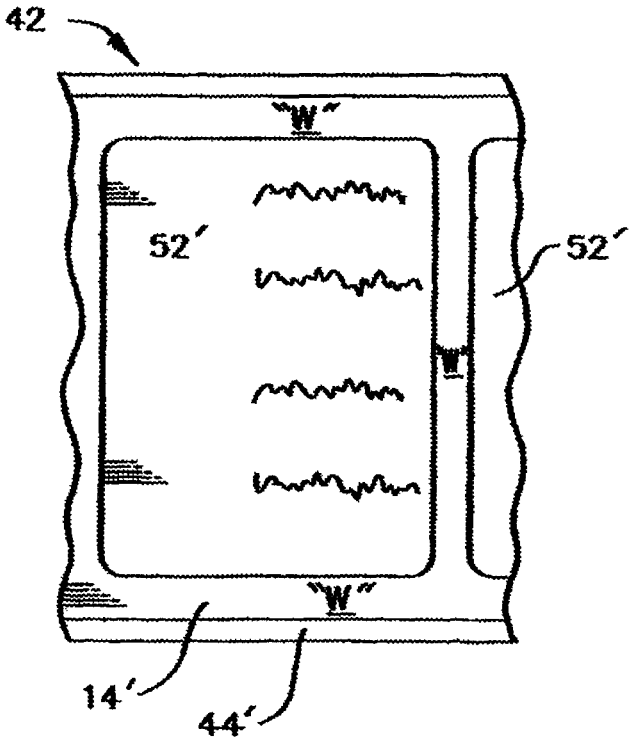
FIG. 29 depicts an alternative form of base label web.

FIGS. 28 and 29 depict alternative forms of the base label web 42 after die cutting through the base label sheet 44 (but not the liner 14) to form base label blanks 52. In FIG. 28, the die cutting operation may provide two base label blanks 52, the width of each blank 52 enabling it to provide a base label 16 (FIG. 19) for two labels 12. In the alternative arrangement shown in FIG. 29, a single base label blank 52' may be provided, of a width enabling it to provide a base label 16 for four labels 12. Other equivalent arrangements may occur to those skilled in the art. After die cutting, waste material "W" around the base label blanks may be stripped from the base label web 42.

Figure 30:
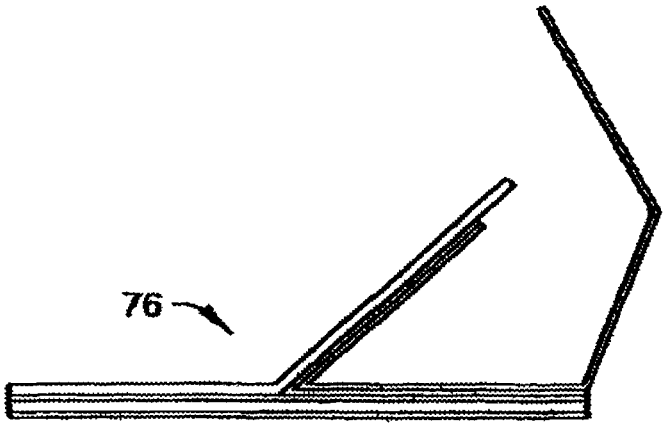
FIG. 30 is a plan view illustrating a brochure blank assembly associated with a base label web in accordance with the invention.
Figure 31:
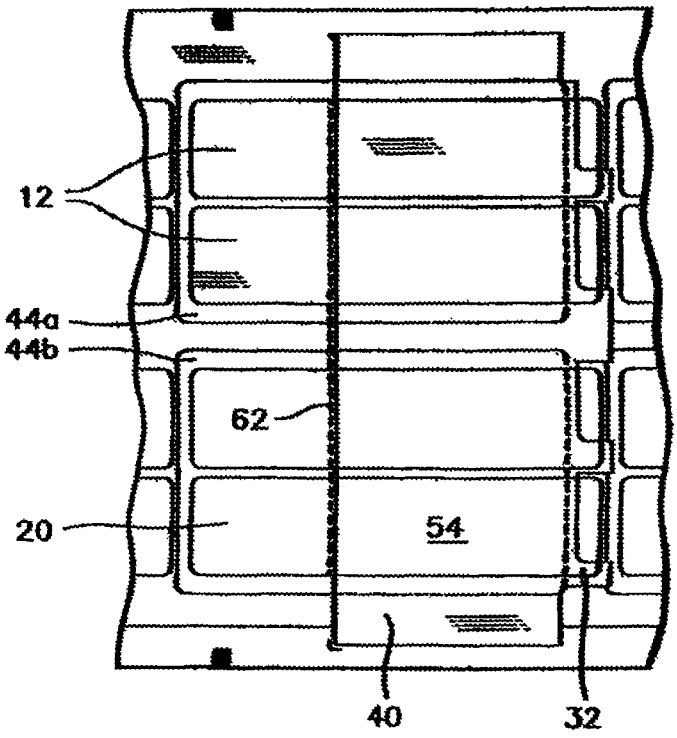
FIG. 31 is a view similar to FIG. 30, illustrating the step of die cutting to produce finished labels.

Referring now to FIGS. 30 and 31, the step of joining the brochure blank assembly 40 with the base label web 42 is illustrated. As is best seen in FIG. 30, the brochure blank assembly 40 may be brought into juxtaposition with the base label web 42 in such a way that the fold 30 extends transversely with respect to the base label sheet 44. It may be recognized that this operation may be automated in ways familiar to those skilled in the art, drawing brochure blank assemblies 40, for example, from a hopper (not seen) and synchronizing the application of brochure blank assemblies 40 to a moving base label web 42. Folding of the brochure blank 40 may be done in such a way as to provide an assembly having a top panel 54, which ultimately forms the above-mentioned top leaves 26 of the brochures 18, and a bottom panel 56, which may ultimately form the bottom leaves 28 of the brochure 18. Associated with the top panel 54 may be projections 58 which, after further cutting described below, may form the tabs 32 associated with the top leaves 26. The top panel 54, it should be understood, may extend from the fold line 30 a distance greater than the width of the bottom panel 56, so that when the brochure blank assembly 40 is positioned with respect to the base label web 42, the panel 54 may project beyond a lateral edge 60 of what will become the base label 16.

A continuous transparent overlayer 20 may be next applied, by conventional laminating techniques, over the joined brochure blank assembly 40 and base label web 42, covering and adhering to the portions of the base label blanks 52 not covered by the brochure blank assembly 40, to the top panel 54 of the brochure blank 40, and to the remainder of the base label web 42.

Referring now to FIG. 31, the final die cutting step will now be described. In this step, the individual labels 12 may be cut to their final external dimensions by cutting through the overlayer 20, the brochure blank assembly 40 and the base label blanks 52, but not the liner 14. This die cutting step may establish the final outline of the tabs 32 as well. Stripping from the liner 14 of the excess material (i.e., material outside the outline of the label as defined by the die) yields the label assembly 10 depicted in FIG. 19.

The overlayer 20 may also be perforated, as at 62 in FIG. 31, adjacent to the fold line 30 of the brochure blank assembly 40. Such a perforation facilitates selective ready removal of the entire brochure 18 from a label 12, by grasping of the brochure and tearing of the overlayer 20 along the perforation 62. The perforation 62 may be made as part of the final die cutting step described above, by die cutting through the overlayer 20.

Figure 22:
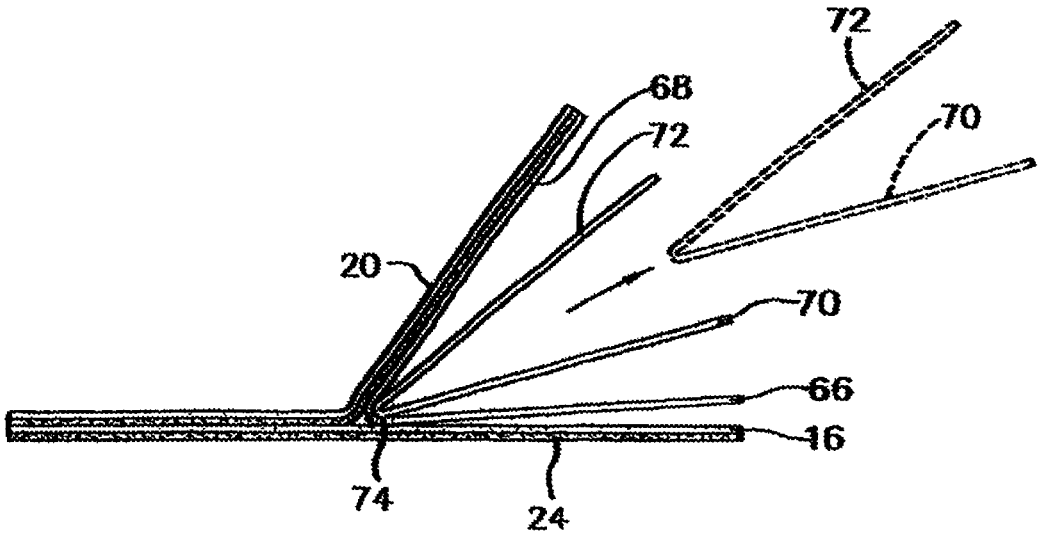
FIG. 22 is a cross-sectional view of another form of label in accordance with the invention.

FIGS. 21 and 22 illustrate particular features of various forms of labels in accordance with the invention. In FIG. 21, there is shown in dotted line the manner in which one of the leaves of the brochure may be removed, for use as a return coupon or a source of information. For this purpose, a line of perforations 63 may be provided across the leaf 28 in a direction transverse to the leaf, to facilitate removal of the leaf. The perforation 63 may be made during printing or die cutting of the brochure blank assembly from which the brochure 18 is made.

Figure 26:
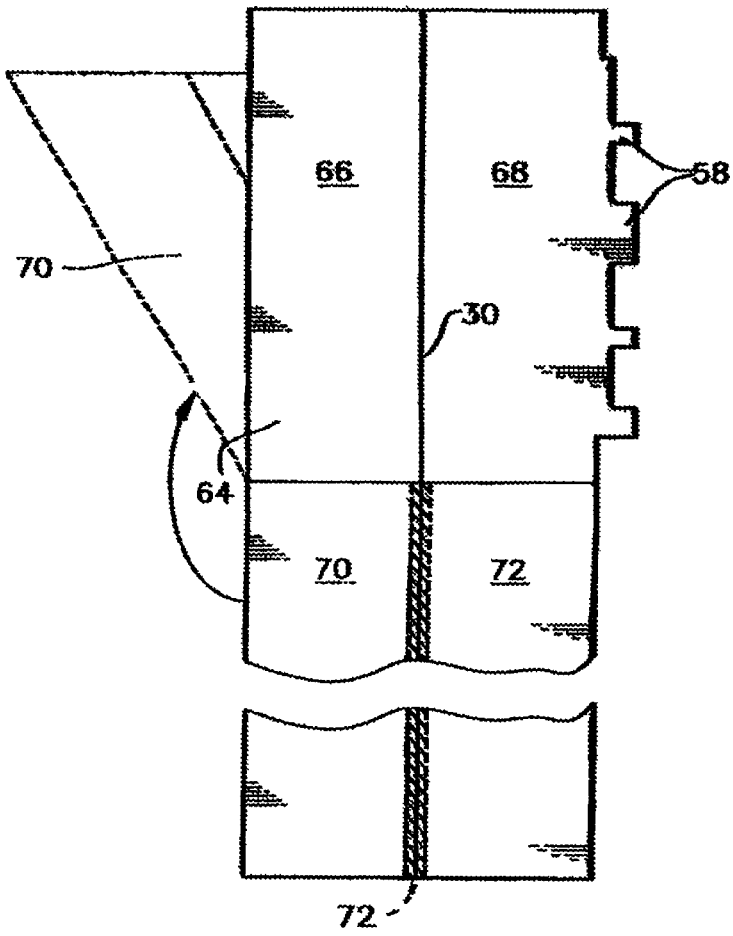
FIG. 26 is a plan view of a brochure blank for use in an alternative form of the invention.

FIGS. 22 and 26 illustrate aspects of an alternative form of the invention, which provides a potential for eight pages of text within a brochure made up of four leaves. In this embodiment a brochure blank 64, as seen in FIG. 26, is so folded as to provide respective panels 66, 68, 70, and 72. The panels 70 and 72, it will be understood, may be folded behind the panels 66 and 68, and the thus-folded blank 64 thereafter used in the manner described above in connection with the brochure blank assembly 40. Final die cutting in the manner described above yields from the panels 66-72 a total of 4 leaves.

It will be appreciated that in folding the brochure blank 64, a line of glue 74 may be applied to the blank 64, as illustrated in FIG. 26, to maintain the leaves provided by the panels 70 and 72 in position relative to the other panels after the final die cutting step. The glue 74 may be applied in a conventional manner before the folding step. As is apparent from FIG. 22, with this embodiment, one pair of leaves may, if desired, be extracted from the brochure as a return coupon or informational piece.

Figure 33:
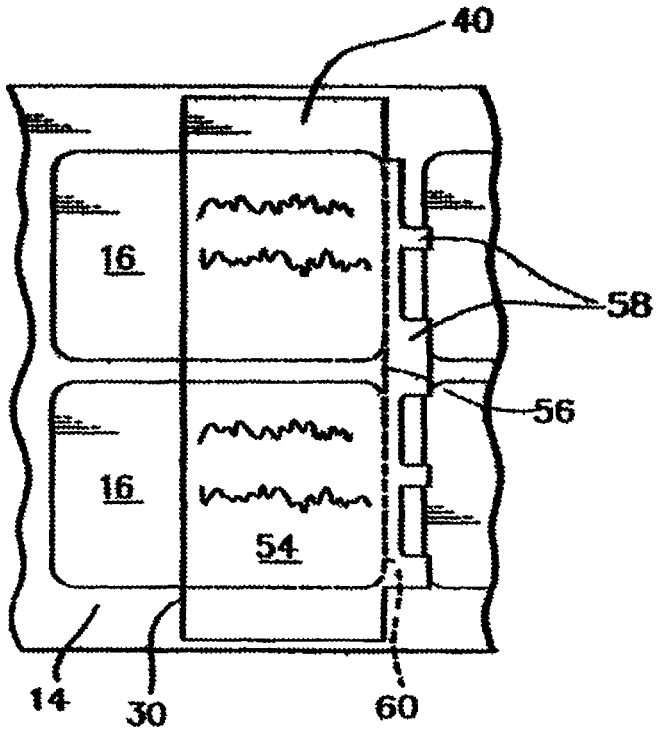
FIG. 33 is a cross-sectional view of yet another form of label in accordance with the invention.

Those skilled in the art will appreciate that although the above-described embodiments of the brochure are "book-like" in the sense that they have leaves joined at a spine (defined by a fold line), it is within the purview of the invention to provide a brochure whose panels are joined by spaced parallel fold lines. Such an embodiment of the invention is seen in FIG. 33 and designated generally by reference numeral 76.

Figure 34:
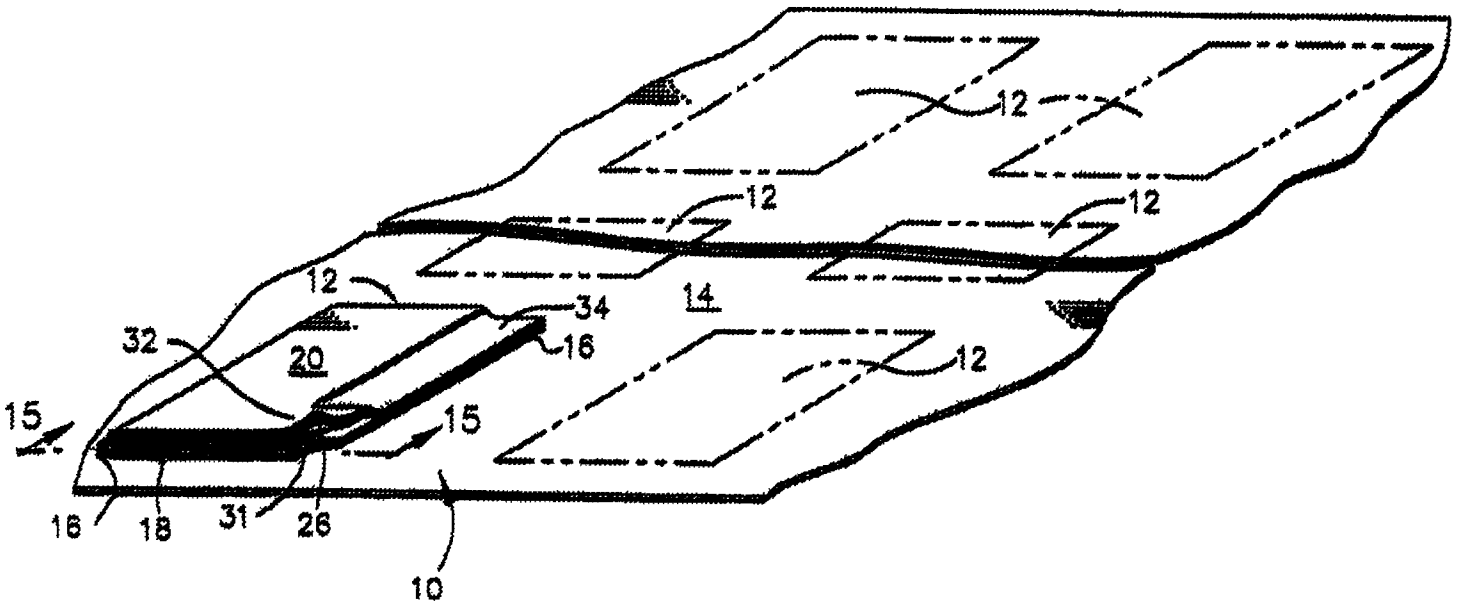
FIG. 34 is a pictorial view, in perspective, of another form of the label assembly in accordance with the invention.
Figure 35:
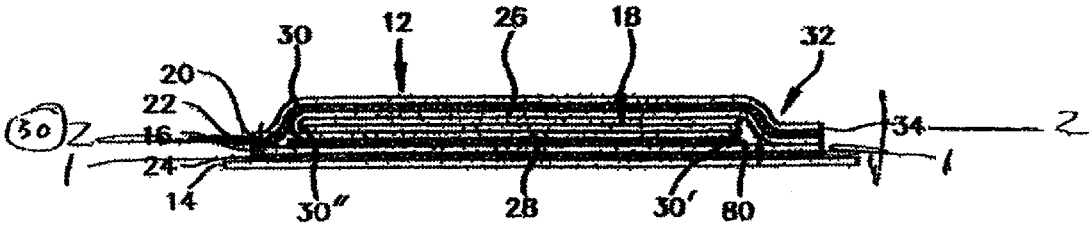
FIG. 35 is a cross-sectional view taken along the line 15-15 in FIG. 34 of a label of this invention in a closed position.

FIGS. 34 through 40 depict yet another embodiment of this invention. Referring to FIGS. 34 and 35, label 12 comprises base label 16, brochure 18 and overlayer 20. Brochure 18 may comprise any number of panels as exemplified by the seven panel construction depicted in FIGS. 34-37. Seen in FIG. 35 is adhesive layer 22 by which overlayer 20 is secured to top leaf 26 of brochure 18 and base label 16, an adhesive layer 80 which secures bottom leaf 28 of brochure 18 to base label 16, and adhesive layer 24 which releasably secures base label 16 to liner 14.

Figure 36:
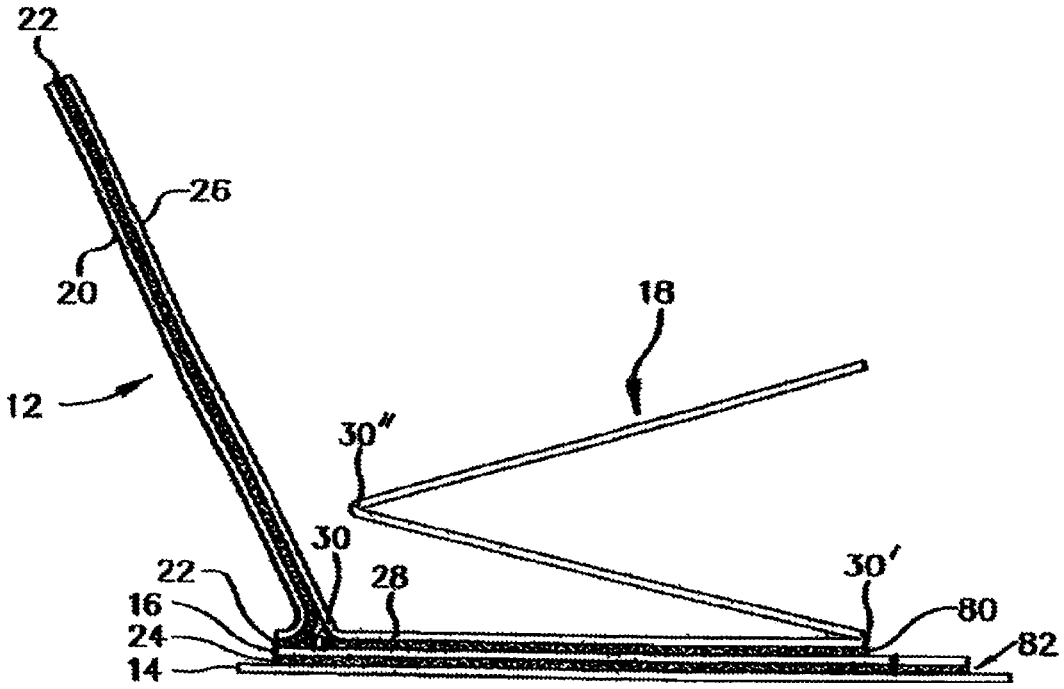
FIG. 36 is a cross-sectional view taken along the line 15-15 in FIG. 34 of a label of this invention in an open position.

Although brochure 18 in FIGS. 34-37 is a leaflet which is formed or folded to provide seven printed surfaces or "panels," it will be apparent to those skilled in the art that label 12 may accommodate numerous configurations of brochure 18. In the embodiment of FIGS. 34-37, fold line 30 separates leaves 26 and 28. Fold line 30 also forms an area in which the additional panels of brochure 18 may be folded (for example along fold lines 30' and 30" as shown in FIGS. 35 and 36 and inserted between leaves 26 and 28 when label 12 is in the closed position.

Top leaf 26 may be wider than bottom leaf 28, and thus extends further from fold line 30 than does bottom leaf 28. Such extra width associated with top leaf 26 over bottom leaf 28 may allow for more easy wrapping of brochure 18 around a container because the extra width of top leaf 26 over bottom leaf 28 accommodates the difference in diameter between top leaf 26 and bottom leaf 28 when they are wrapped around a container and the panels of brochure 18 are in between them. Such difference in diameter between top leaf 26 and bottom leaf 28 may be due to the thickness of brochure 18 or the thickness of bottom leaf 28 and top leaf 26. The greater the thickness of brochure 18 and/or the bottom and top leaves, the greater the difference in diameter between them may be when they are wrapped around a container. As brochure 18 is wrapped around a container, the panels of brochure 18 that may be closest to the container may be prevented from buckling, warping, and/or wrinkling by making top leaf 26 wider than bottom leaf 28 to accommodate the difference in diameters that may exist subsequent to wrapping them around a container, as may be illustrated in at least FIG. 23. Top leaf 26 may be any amount wider than the bottom leaf 28 so as to allow bottom leaf 28 to remain flat and even when it and top leaf 26 are wrapped around a container together. In addition, top leaf 26 and bottom leaf 28 may have the ability to shift and slide against each other as they are wrapped around a container together, thereby allowing bottom leaf 28 to be flat and even after top leaf 26 and bottom leaf 28 are wrapped around a container.

Furthermore, any other bunching, warping, buckling, and/or rippling of bottom leaf 28 as it is wrapped around a container with top leaf 26 may be prevented by allowing a gap to exist in the brochure structure between brochure 18 and layers 16, 22, and 20, as may be illustrated in, at least, FIGS. 21 and 23. Such gap may be of any size and may allow bottom leaf 28 more space to shift into position as bottom leaf 28 and top leaf 26 are wrapped around a container, thereby preventing bunching, warping, buckling, and/or rippling of bottom leaf 28. Such gapped fold region may allow bottom leaf 28 to lie flat and even on a container after it and top layer 26 are wrapped around a container. A portion of top leaf 26 designated as area 32 in FIGS. 34, 35 and 37 extends beyond lateral edge 31 of base label 16 shown in FIG. 34.

Additionally, brochure 18 may be modified to provide an even more pleasing configuration for label 12. The individual panels of brochure 18 may be of increasing widths, such that the panel to be closest to the container to be wrapped is of least width and all other panels to lie successively outside the panel closest to the container are of increasing width such that, when brochure 18 and all its panels are wrapped around a container as a part of label 12, brochure 18 does not buckle, warp, wrinkle, and/or ripple. This means that folds 30 and 30,' as may be illustrated in FIG. 36, may be offset from each other once the panels of brochure 18 are all lying against each other when label 12 is flat. Furthermore, once label 12 is wrapped around a container, each panel of brochure 18 may be allowed to lie flat and even with no wrinkling or bunching because panels closest to the container may have shorter widths than the panels of increasing distance from the container.

As will be apparent to those skilled in the art, label 12 as depicted in FIGS. 34-37 may be affixed to containers with various cross-sections including, but not limited to, containers 38 shown in FIGS. 23 and 24.

As mentioned previously, label 12 may be any label as described herein, may take any of the numerous shapes as described herein, and may be adhered to the entire surface area of container 38 or any portion of container 38, such as container 38 shown in FIG. 24. For example, label 12 of FIG. 34 may be adhered to any one of the four sides of container 38 shown in FIG. 23. Alternatively, label 12 could be adhered to any two sides and any corner of container 38.

Figure 37:
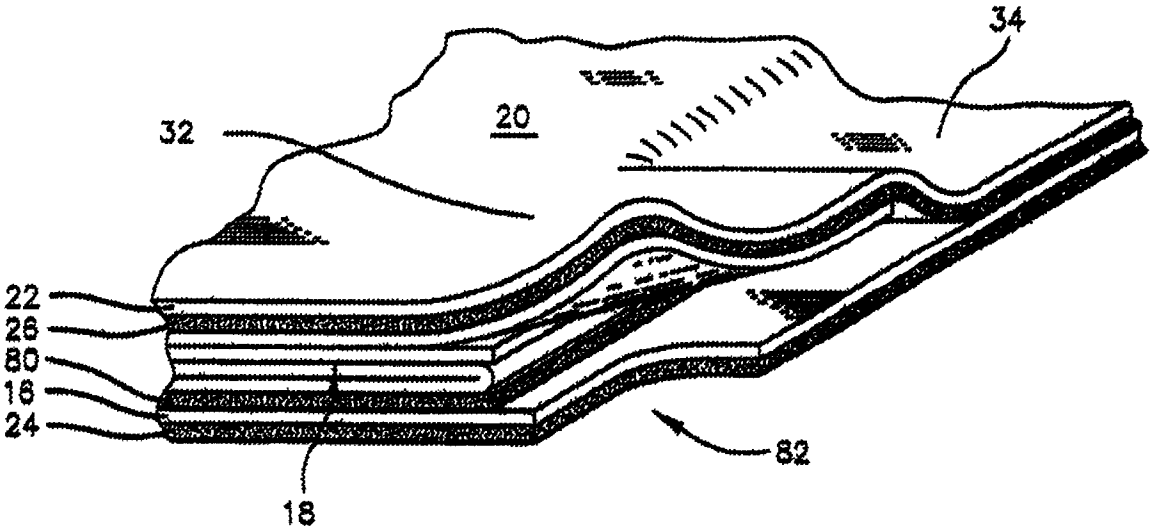
FIG. 37 is a detail view of a portion of the label of FIG. 34.

Tab 32 of label 12 depicted in FIGS. 34, 35, and 37 (shown with a corner turned upward in order to demonstrate the flexibility of tab 32) facilitates the opening of the brochure because it is interposed between leaf 26 of brochure 18 and container 38, and further, because of notched opening 82 in base label 16. When applied to container 38, relief notch 82 creates a space between leaf 26 and the substrate (such as container 38) to which label 12 is affixed. Tab 32 thus provides a convenient "handle" and an aid to gaining access to brochure 18. On the other hand, as best shown in FIG. 37, adhesive 22 present on portion 34 of overlayer 20 facilitates repeated unsealing and resealing of brochure 18 as container 38 is used.

The materials used in the construction of this embodiment of the invention depicted in FIGS. 34-37 may be the same as used in the construction of other embodiments of this invention. In addition, adhesive 80 may be any material suitable for adhering brochure 18 to base label 16 and may also be a cold glue.

Referring now to FIGS. 34 and 38-40, a method of making an adhesive label assembly in accordance with the instant embodiment of label 12 will be described.

In general, the method involves the following steps, each of which will be described in greater detail below: brochure blank assembly 40 may be created by printing, cutting and folding. Brochure blank assembly 40 may be prepared in full web width. Base label 16 may be printed, also in full web width. Next, base label 16 may be die cut from base label web 42 (which, in part, forms relief notch 82) and excess waste (depicted in the accompanying figures as "W") may be stripped from base label blanks 52, each blank ultimately providing, in the presently preferred form of the method, three base labels 16. Next, brochure blank assembly 40 may be affixed to base label blank 52 by applying adhesive 80 to base label blank 52 and joining brochure blank assembly 40 to adhesive 80. Although in this embodiment adhesive 80 may be necessary if brochure 18 is to remain affixed to base label 16, it is not necessary to use adhesive 80 if brochure 18 is to be completely removed from label 12. Overlayer 20 may then be applied over exposed liner 14, base label blank 52, and brochure blank assembly 40. Finally, base label blank 52, brochure assembly 40 and overlayer 20 may be die cut to final outline 86 of label 12, and waste "W" may be stripped to yield the final label assembly.

Figure 38:
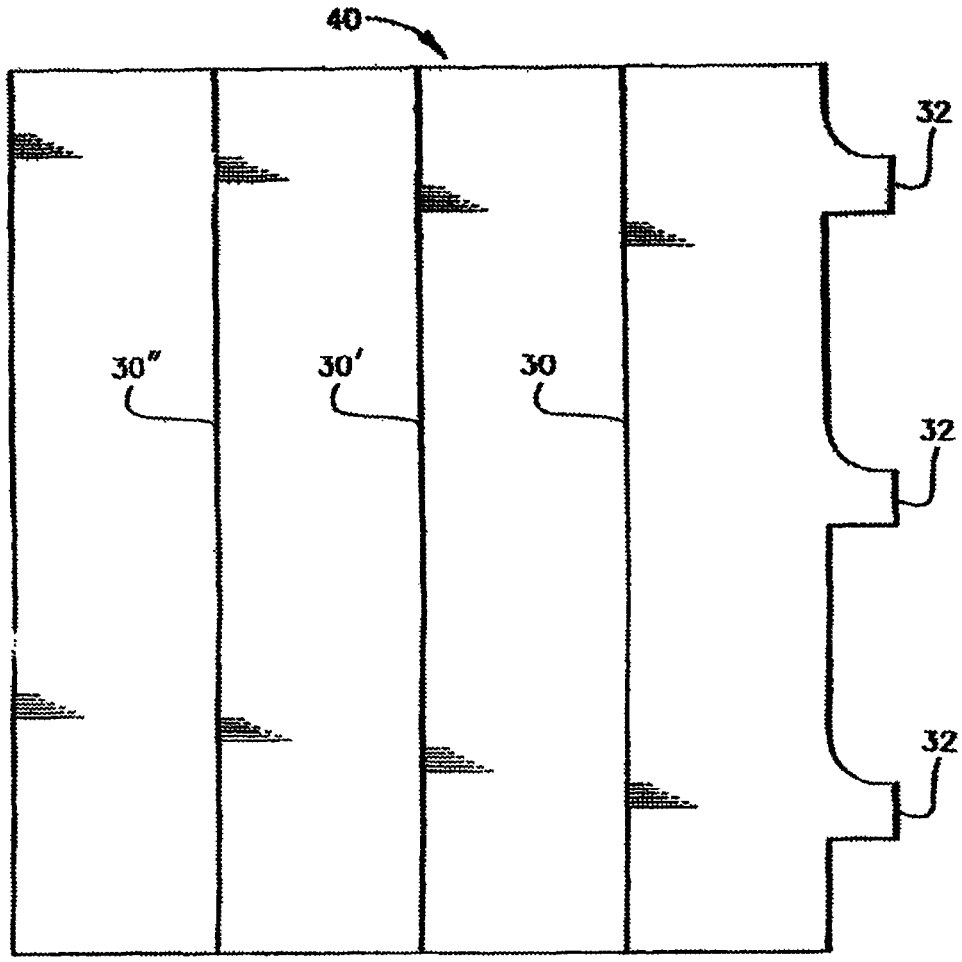
FIG. 38 is a plan view of a brochure blank for use with the label of FIG. 34.

Referring now to FIG. 38, brochure blank assembly 40 may be created as follows: brochure blanks may be printed by any suitable process. In the presently preferred process, brochure blank 40 may be printed by sheet-fed offset printing in full sheets (typically about twenty-four inches wide) and which may be cut in half to form a full web width (typically about approximately twelve inches). Each full web width may contain multiple repetitions of printed matter. One form of the process may print on each full web width three brochures 18. Optionally, brochures may be printed on one or both sides of brochure blank assembly 40. The portions of brochure blank assembly 40 which, with further trimming, will ultimately form tabs 32 of the embodiment of FIGS. 34-37, may be die cut, although other techniques may occur to those skilled in the art. The full web width may then be trimmed to size and folded as desired, such as at fold lines 30, 30' and 30" depicted in FIG. 38.

Figure 39:
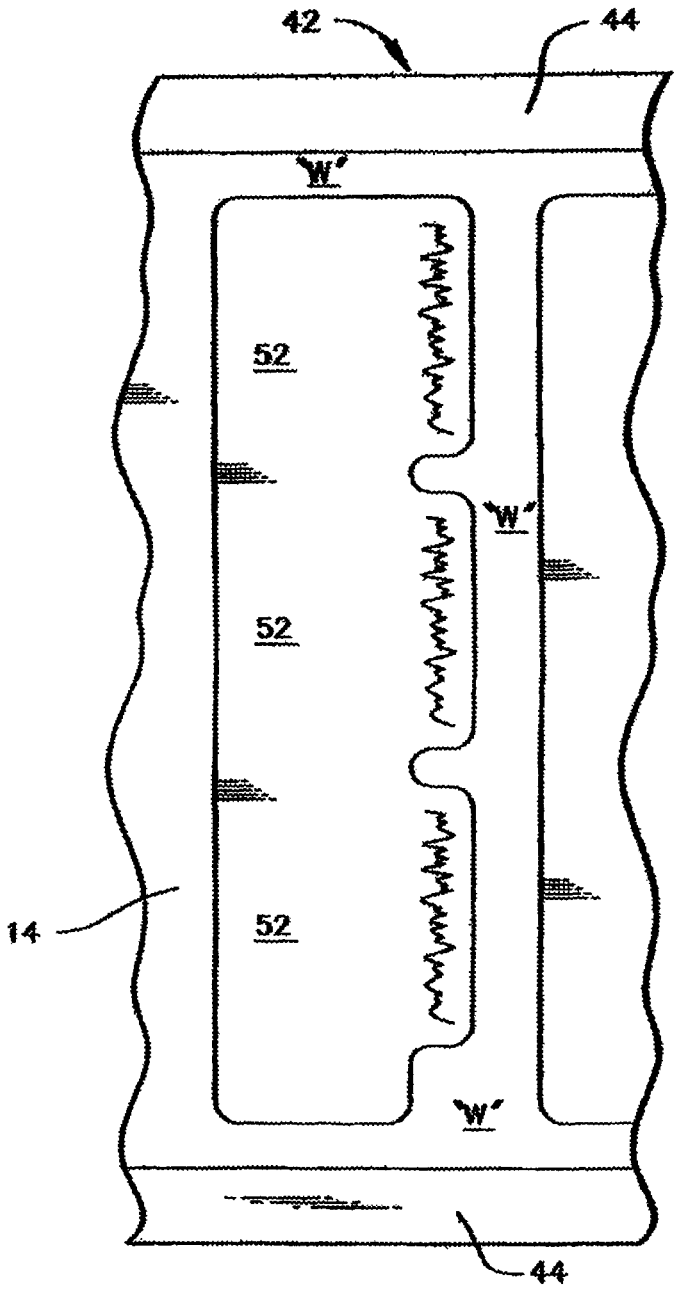
FIG. 39 depicts a base label web, die cut prior to stripping waste, to provide intermediate blanks for base labels in accordance with the invention.

Turning now to FIG. 39, base label web 42 of this embodiment may be printed as disclosed above, except that three rather than four repetitions may be printed across base label web 24, although other repetitions may also be possible.

FIG. 39 depicts a form of base label web 42 after die cutting through base label sheet 44 (but not liner 14) to form three attached base label blanks 52. The die cutting operation of FIG. 39 provides three attached base label blanks 52, which blanks 52 may be separated in a later step in the process. The width of each blank 52 enables it to provide a base label 16 for three labels 12. Other equivalent arrangements may occur to those skilled in the art. After die cutting, the waste material "W" around base label blanks 52 may be stripped from base label web 42.

Figure 40:
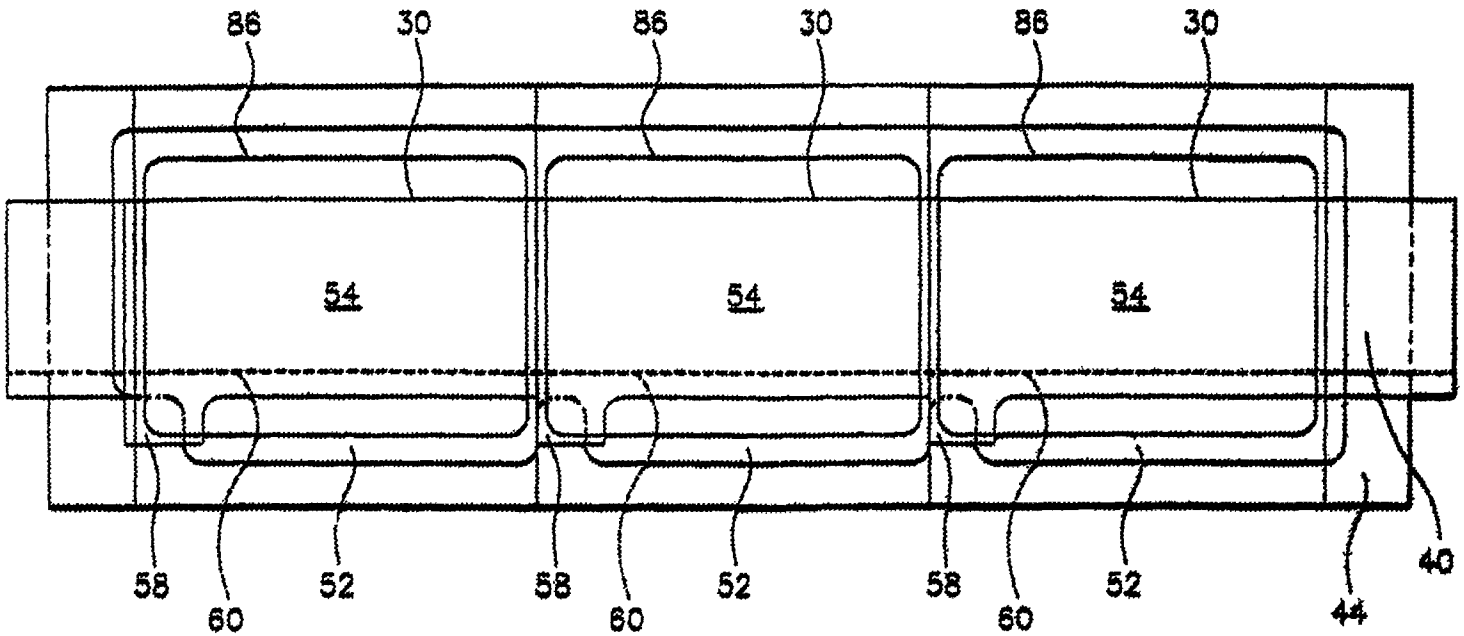
FIG. 40 is a plan view illustrating the brochure blank assembly associated with the base label web in accordance with the label of FIG. 34.

Referring now to FIG. 40, the step of joining the brochure blank assembly 40 with base label web 42 is illustrated. First, adhesive 80 is applied to a section of each label blank 52 at which section brochure blank assembly 40 may be applied to label blank 52. Adhesive 80 may be applied to base label blanks 52 in a continuous area approximately the size and shape of brochure blank assembly 40. Alternatively, adhesive 80 may be applied to the underside of brochure leaf 28.

After application of adhesive 80, brochure blank assembly 40 may be brought into juxtaposition with base label web 42 in such a way that fold 30 extends transversely with respect to base label sheet 44. It will be recognized that this operation may be automated in ways described above with respect to the embodiment of the invention described herein. Folding of brochure label 40 may be done in such a way as to provide an assembly having a top panel 54, which ultimately forms the above-mentioned top leaves 26 of brochures 18, and bottom panels 56 (not shown in FIG. 40), which ultimately forms bottom leaves 28 of brochure 18. Associated with top panel 54 may be projections 58 which, after further cutting described below, form tabs 32 associated with top leaves 26. Top panel 54, it should be understood, extends from fold line 30 a distance greater than the width of bottom panel 56, so that when brochure blank assembly 40 is positioned with respect to base label web 42, panel 54 may project beyond lateral edge 60 of what is fold 30' such that top panel 54 may contact at least a portion of label blank 52.

A continuous transparent overlayer 20 may next be applied, by conventional laminating techniques, over joined brochure blank assembly 40 and base label web 42, covering and adhering to the portions of base label blanks 52 not covered by brochure blank assembly 40, to top panel 54 of brochure blank 40, and the remainder of the base label web 42.

The final die cutting step may be substantially as described with respect to other embodiments of this invention. In this step, individual labels 12 may be cut to the final external dimensions. This die cutting step establishes a final label outline 86 of label 12 (including tab 32) as depicted in FIG. 40. Stripping from liner 14 of excess material (i.e., material outside final label outline 86) yields label assembly 10 depicted in FIG. 34.

Those of ordinary skill in the art may recognize that many modifications and variations of the present invention may be implemented without departing from the spirit or scope of the invention. Thus, it is intended that the present invention covers the modifications and variations of this invention provided they come within the scope of the appended claims and their equivalents.

What is claimed is:

1. A method of making a label having at least one resealable brochure and being suitable for attachment to a mounting surface, said method comprising:

providing a base planar member having oppositely disposed first and second surfaces and a first lateral edge, said first surface being suitable for coupling said base planar member to said mounting surface;

providing at least one brochure sheet;

laying at least a portion of said at least one brochure sheet over said base planar member;

coupling at least a portion of said second surface of said base planar member and at least a portion of said at least one brochure sheet with at least one planar overlying member;

wherein, a portion of said at least one brochure sheet and overlying member project beyond said first lateral edge of said base planar member such that when said label is attached to said mounting surface, said at least one overlying member may be selectively uncoupled and recoupled to said mounting surface.

2. The method of claim 1, wherein said overlying member projecting beyond said first lateral edge of said base planar member at least partially forms at least one tab.

3. The method of claim 1, wherein said portion of said at least one brochure sheet and said overlying member projecting beyond said first lateral edge of said base planar member at least partially form at least one tab.

4. The method of claim 1, further comprising foaming at least one tab in said portion of said overlying member projecting beyond said first lateral edge of said base planar member prior to said coupling step.

5. The method of claim 1, further comprising forming at least one tab in said portion of said at least one brochure sheet and said overlying member projecting beyond said first lateral edge of said base planar member prior to said coupling step.

6. The method of claim 4, wherein said step of forming at least one tab comprises die cutting said at least one tab.

7. The method of claim 5, wherein said step of forming at least one tab comprises die cutting said at least one tab.

8. The method of claim 1, wherein said step of providing at least one brochure sheet comprises providing at least one brochure sheet having a removable sheet.

9. The method of claim 1, further comprising adhesively coupling said base planar member to said mounting surface after said coupling step.

10. The method of claim 1, wherein said base planar member is a label.

11. The method of claim 1, wherein said resealable brochure has one or more at least partially superimposed panels.

12. The method of claim 11, wherein at least one of said panels is removable.

13. The method of claim 11, wherein said resealable brochure has at least one fold line in said at least one brochure sheet, said at least one fold line at least partially defining said panels.

14. The method of claim 1, wherein said base planar member has at least a second lateral edge such that when said second surface of said base planar member is secured to said mounting surface, said portion of said at least one brochure sheet and planar overlying member that project beyond said first lateral edge of said base planar member at least partially overlap said second lateral edge.

15. The method of claim 1, wherein said at least one planar overlying member is a film.

16. The method of claim 15, wherein said film is a clear plastic polymeric film and said base planar member comprises a paper sheet.

17. The method of claim 1, wherein said base planar member comprises at least one relief notch.

18. The method of claim 1, further comprising:

providing a first label portion having a pre-print;

providing a second label portion having a second pre-print; and providing a composition coating at least one of a portion of said first label portion and a portion of said second label portion, wherein said composition is reactive to activation by targeted laser light; and providing a secondary printing in addition to at least one of said pre-print and said second pre-print by activating said composition coating with said targeted laser light.

19. The method of claim 18, wherein said providing a secondary printing step further comprises activating printing of indicia with laser light within said composition coating.

20. The method of claim 18, wherein said composition coating comprises a laser-reactive protective coating.

21. A label having at least one resealable brochure and suitable for being attached to a mounting surface, said label comprising:

a base planar member including oppositely disposed first and second surfaces and a first lateral edge, said first surface being suitable for coupling said base member to said mounting surface;

at least one brochure sheet including a second lateral edge which at least partially overlies said base member;

at least one planar overlying member coupled to said second surface of said base member and said at least one brochure sheet; and at least one planar tab member;

wherein a portion of said overlying member projects beyond said first lateral edge of said base member and said second lateral edge of said at least one brochure sheet such that, when said label is attached to said mounting surface, said planar overlying member may be selectively uncoupled and recoupled to said mounting surface; and wherein a portion of said at least one planar tab member is adhered to a portion of said planar overlying member projecting beyond said first lateral edge of said base member and said second lateral edge of said at least one brochure sheet such that said at least one planar tab member is formed for facilitating said uncoupling and recoupling of said planar overlying member to said base member.

22. The label of claim 21, wherein said at least one brochure sheet comprises at least one removable sheet.

23. The label of claim 21, wherein said base member is adhesively coupled to said mounting surface.

24. The label of claim 21, wherein said base member is a label.

25. The label of claim 21, wherein said brochure comprises one or more at least partially superimposed panels.

26. The label of claim 25, wherein at least one of said panels is removable.

27. The label of claim 26, further comprising at least one fold line in said at least one brochure sheet, said at least one fold line at least partially defining said panels.

28. The label of claim 21, wherein when said first surface of said base label is secured to said mounting surface, said portion of said overlying member that projects beyond said first lateral edge is adhesively coupled to said mounting surface.

29. The label of claim 21, wherein said overlying member comprises a film.

30. The label of claim 21, wherein said film is a clear plastic polymeric film and said base member comprises a paper sheet.

31. A label having at least one resealable brochure and suitable for being attached to a mounting surface, said label comprising:

a base planar member including oppositely disposed first and second surfaces and a first lateral edge, said first surface being suitable for coupling said base member to said mounting surface;

at least one brochure sheet including a second lateral edge which at least partially overlies said base member;

at least one planar overlying member coupled to said second surface of said base member and said at least one brochure sheet; and wherein a portion of said planar overlying member projects beyond said first lateral edge of said base member such that, when said label is attached to said mounting surface, said planar overlying member may be selectively uncoupled and recoupled to said mounting surface;

wherein a portion of said at least one brochure sheet and said planar overlying member projects beyond said first lateral edge of said base layer such that an at least one tab section, wherein said at least one tab section has a width less than said planar overlying member, and is formed for facilitating said uncoupling and recoupling of said planar overlying member to said base member; and wherein said planar overlying member and said at least one brochure sheet are sized and shaped to accommodate a container to which said label is to be affixed.

* * * * *

UNITED STATES PATENT AND TRADEMARK OFFICE
Certificate

Patent No. 8,671,599 B2 Patented: March 18, 2014

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Neil G. Sellars, Cinnaminson, NJ (US); Veronica Bellenger, Plymouth Meeting, PA (US); Nan V. Shacklett Sweeney, Blue Bell, PA (US); and Gabriel J. Imhof, Port Saint Lucie, FL (US).

Signed and Sealed this Ninth Day of December 2014.

CHARLES A. FOX
*Supervisory Patent Examiner*
Art Unit 3638
Technology Center 3600